US005653542A

United States Patent [19]

Sugimoto et al.

[11] Patent Number: 5,653,542

[45] Date of Patent: Aug. 5, 1997

[54] TAPE CASSETTE

[75] Inventors: Kiyoshi Sugimoto, Mie-ken; Koshiro Yamaguchi, Aichi-ken; Takashi Horiuchi, Aichi-ken; Yutaka Sugiyama, Aichi-ken, all of Japan

[73] Assignee: Brother Kogyo Kabushiki Kaisha, Aichi-Ken, Japan

[21] Appl. No.: 450,356

[22] Filed: May 25, 1995

[30] Foreign Application Priority Data

May 25, 1994 [JP] Japan ..... 6-136328

[51] Int. Cl.[6] ..... B41J 35/04

[52] U.S. Cl. ..... 400/248; 400/207

[58] Field of Search ..... 400/248, 247, 400/208, 207, 615.2, 616

[56] References Cited

U.S. PATENT DOCUMENTS

| | | | |
|---|---|---|---|
| 4,927,278 | 5/1990 | Kuzuya et al. | 400/208 |
| 5,188,469 | 2/1993 | Nagao et al. | 400/615.2 |
| 5,195,835 | 3/1993 | Collins | 400/248 |
| 5,348,406 | 9/1994 | Yoshiaki et al. | 400/615.2 |
| 5,419,643 | 5/1995 | Matsuura | 400/208 |
| 5,443,319 | 8/1995 | Sugiura et al. | 400/208 |
| 5,500,669 | 3/1996 | Yamashita et al. | 400/208 |

OTHER PUBLICATIONS

Japanese Provisional Publicational No. HEI 2-106555.

*Primary Examiner*—Edgar S. Burr
*Assistant Examiner*—Anthony H. Nguyen
*Attorney, Agent, or Firm*—Kane, Dalsimer, Sullivan, Kurucz, Levy, Eisele and Richard, LLP

[57] ABSTRACT

A tape printer cassette, bearing a film tape and ink ribbon on spools therein, maintains the film tape in a feed path defined by an outer wall and a partition and the ink ribbon in a feed path defined by the partition and an inner wall. The inner wall and the partition are set to be substantially the same height as the ink ribbon and higher than the outer wall. When the ink ribbon is wider than the film tape, an unused portion of the ink ribbon remains after printing; regulating members spaced by the width of the film tape, downstream of the printing region, keep the film tape in the center of the ribbon so that the unused portion remains and so that the ink ribbon cannot proceed along the film tape feed path past the regulating members. When an adhesive backing is also provided on a spool in the cassette, regulating members align the film tape and adhesive backing at a feed capstan so that they are not displaced relative to each other when adhered.

19 Claims, 17 Drawing Sheets

TAPE CASSETTE

BACKGROUND OF THE INVENTION

This invention relates to a tape cassette for tape printers, and more particularly, to a tape cassette having a cassette case with a film tape spool and an ink ribbon spool therein, a feed path for ribbons and film tapes of differing widths, and guiding members for the ribbons and tapes.

Various types of tape cassette to be employed in a tape printer have been proposed. A modern tape printer cassette generally includes a film tape as the printing medium and an ink ribbon provided within a cassette case. Often, the cassette case includes an upper case portion and a lower case portion, joined to form the cassette; images are printed on the film tape using an ink ribbon by means of a thermal head provided in a tape printer.

In these tape cassettes, the height of the outer wall of the lower case and the height of the ink ribbon guide are generally the same, and the same as the width of the ink ribbon therein. Consequently, if an ink ribbon employed in a cassette has sufficient width to cover various film tape widths, the height of the outer wall of the lower case, as well as the height of the ribbon guide, must necessarily increase. Conversely, if the height of the ribbon guide and the height of the outer wall of the lower case are lower than the ink ribbon width, the ink ribbon protrudes above of the ribbon guide and the outer wall, such that the joint surface of the upper and lower cases is adjacent the body of the ink ribbon. When the mating surfaces of the upper and lower cases of the cassette are adjacent the body of the ink ribbon, the think ink ribbon may be wrinkled or nipped when the upper and lower cases are joined. To combat this problem, the ribbon guide and lower case could be formed higher to corresponding to the ribbon width of the larger ribbon. It is, however, very difficult to resin-mold a high external wall all around the case, that is, a generally deep lower case, as the molding of deep, thin-walled shells is difficult.

With the conventional tape cassette, if the ink ribbon and the film tape are fed along the same feeding path to the thermal head, due to limited space available in the modern compact printer, the ink ribbon and the film tape are fed touching each other. If the film tape becomes rippled, the ink ribbon becomes rippled, causing images printed on the film tape to become blurred. In a tape cassette of the laminate type (a printed tape made by adhering a adhesive backing to a film tape after printing), if the film tape is drawn manually by a user handling the tape cassette, it is possible, although rare, that the ink ribbon can be drawn out along with the film tape and adhesive backing. In this case, the ink ribbon can adhere to the adhesive backing, ruining the tape cassette.

The ink ribbon is typically quite fragile. If the ink ribbon is the same width as the film tape, then when many characters or images are continuously printed, the ink ribbon can be weakened by heat or the removal of material across its entire width. This is especially true when printing in "negative"; that is, printing such that ink is transferred to form a surrounding dark background around character shapes while leaving the actual character shapes without ink, resulting in the appearance of light characters on a dark background. If the ribbon is sufficiently weakened, it can break easily.

The film tape and adhesive backing are typically almost exactly the same width, and are difficult to align. Ideally, the film tape and adhesive backing should be perfectly laminated, but especially when a provision is included for a wider ribbon than the film tape, alignment in the width direction is difficult to accomplish due to the various differing widths. Conventionally, between the printing head and the laminating or feed roller, adequate provision for alignment is not made.

SUMMARY OF THE INVENTION

The invention has been made to solve the above-mentioned conventional problems. The objects are to provide a tape cassette in which a guide member controlling the ink ribbon, particularly, does not disturb the ink ribbon during assembly or operation, the cassette being capable of isolating the ink ribbon feed path from the film tape feed path, and capable of performing proper alignment of the ribbon, tape, and backing at appropriate times.

In order to accomplish the objects of the invention, a tape cassette includes a tape spool upon which a film tape is wound, and a ribbon spool, upon which an ink ribbon is wound, arranged in a cassette case including a lower case (having an external wall of a predetermined height) and an upper case. The film tape and ink ribbon are discharged along a predetermined feeding path, and a guide portion is formed in the lower case and in the feed path, so as to guide the film tape and the ink ribbon. The guide portion is provided with a first wall portion having the same height as that of the external wall. A second wall portion is provided, higher than the first wall portion, and substantially the same height as the ink ribbon; and a partition wall is formed between the first and second wall portions, the partition wall being the same height as the second wall portion. The film tape is fed and guided between the first wall portion and the partition wall, and the ink ribbon is fed and guided between the second wall portion and the partition wall.

Thus, as the guided portions of the feed paths of the ink ribbon and the film tape are separated from each other by means of the partition wall, the feeding of the film tape cannot influence the feeding of the ink ribbon.

Although the ink ribbon is wider than the height of the outer wall of the lower case, when the ink ribbon is fed, it is guided by means of the second wall portion and the partition wall, both of which are the same height as the ribbon. Consequently, the ink ribbon can be placed entirely in the lower case during assembly; therefore, wrinkles do not occur on the ink ribbon adjacent the join between the upper and lower cases, and the ink ribbon cannot be nipped between the cases during assembly.

Furthermore, as the second wall portion and the partition wall are formed to match the height of the ink ribbon guided therein, but the outer wall of the case is not increased in height, the lower case can be easily formed without molding difficulties.

In another development of the invention, the ink ribbon is wider than the film tape, and the cassette further comprises a pair of regulating members disposed in the feed path downstream of a printing region of the cassette. A regulating spacing between the regulating members is substantially the same as the width of the film tape and less than the width of the ink ribbon, and the film tape passes through the regulating spacing.

In this manner, the width difference enables positive separation of the film tape from the ink ribbon upstream of the regulating members, which prevents the escape of the ink ribbon. That is, if the ink ribbon is fed towards the regulating members, it cannot intrude between the regulating members.

Therefore, even if the ribbon tends to follow the film tape, the ribbon cannot continue downstream of the regulating members. Furthermore, when the ink ribbon is wider than the film tape, then the ribbon is naturally wider than the printable width of images, and a non-used portion of the ribbon remains at both sides, increasing the ability of the ribbon to resist breaking when weakened.

In another preferred embodiment, the ink ribbon is wider than the film tape, and the cassette further comprises a backing spool upon which an adhesive backing is wound, the backing spool being rotatably mounted in the casing, and the adhesive backing being adhered to the film tape at a point along the feed path downstream of the printing region; and a feed capstan having a face width substantially the same as the width of the film tape. Further provided is a pair of regulating members upstream of the feed capstan, the film tape passing between regulating surfaces of the respective regulating members and the distance between the regulating surfaces being substantially the same as the width of the film tape.

Since the film tape is fed to the feed capstan regulated and guided in the tape width direction by the regulating members while the double-sided adhesive backing is simultaneously fed to and adhered to the film tape, aligned with the tape feed width (face width) of the feed capstan, then the film tape and double-sided adhesive backing are thereby able to properly adhere, without displacement therebetween, in cooperation with the feed capstan and the press roller.

According to another aspect of the invention, the tape cassette further comprises a first pair of film tape regulating members provided at the base of the partition wall between the partition wall and the first wall portion. Further provided are a second pair of film tape regulating members on the upper case opposite the first pair of film tape regulating members, across the width direction of the feed path. The first and second pairs of film tape regulating members cooperate to align the center of the film tape in the width direction with the center of the ink ribbon in the width direction.

The regulation of the film tape by the regulating members (placed only in the tape feed path) in the width direction places the tape approximately in the center of the width of the wider ink ribbon. This ensures that an unused portion of ribbon always remains both on the top and bottom of the ribbon, preserving the resistance of the ribbon against breakage.

Preferably, also provided are a guide pin and bottom regulating members upstream along a feed path of the film tape from the first pair of film tape regulating members. The bottom regulating member aligns the center of the film tape in the width direction with the height of the first pair of film tape regulating members.

According to another aspect of the invention, a tape cassette includes a cassette casing including an upper case and a lower case; a tape spool rotatably mounted in the casing, upon which a film tape is wound; a ribbon spool rotatably mounted in the casing, upon which an ink ribbon is wound; a head recess formed in the cassette casing, and capable of accommodating a printing head support of a printing device; a first coupling slot for positively locating the tape cassette in a first lateral direction, the first coupling slot being a vertically extending groove formed in a first wall of the head recess; and a second coupling slot for positively locating the tape cassette in a second lateral direction perpendicular to the first lateral direction, the second coupling slot being a vertically extending groove formed in a second wall of the head recess substantially perpendicular to the first wall of the recess.

Consequently, the tape cassette can be positively located in two perpendicular lateral directions, for example left-to-right and front-to-back, by means of the coupling slots. Thus, the tape cassette is easily seated with high precision.

According to still another aspect of the invention, a tape cassette mounting system includes a cassette casing including an upper case and a lower case; a head recess formed in the cassette casing; a first coupling slot for positively locating the tape cassette in a first lateral direction, the first coupling slot being a vertically extending groove formed in a first wall of the head recess; a second coupling slot for positively locating the tape cassette in a second lateral direction perpendicular to the first lateral direction, the second coupling slot being a vertically extending groove formed in a second wall of the head recess substantially perpendicular to the first wall of the recess; a printing head support of a printing device, the printing head support bearing a thermal printing head and insertable into the head recess; a first coupling ridge, the first coupling ridge being a vertically extending ridge formed on a first wall of the head support and slidable into the first coupling slot; and a second coupling ridge, the second coupling ridge being a vertically extending ridge formed on a second wall of the head support substantially perpendicular to the first wall of the head support, and the second coupling ridge being slidable into the second coupling slot.

As a result, by sliding the ridges into the matching slots and mating the tape cassette head recess to the printing device head support, the tape cassette is positively located in two perpendicular lateral directions (for example, left-to-right and front-to-back). Thus, the mounting system provides precise and easy alignment and seating of the tape cassette to the printing device, especially with reference to the head support.

DESCRIPTION OF THE ACCOMPANYING DRAWINGS

DESCRIPTION OF THE EMBODIMENTS

Figure 1:
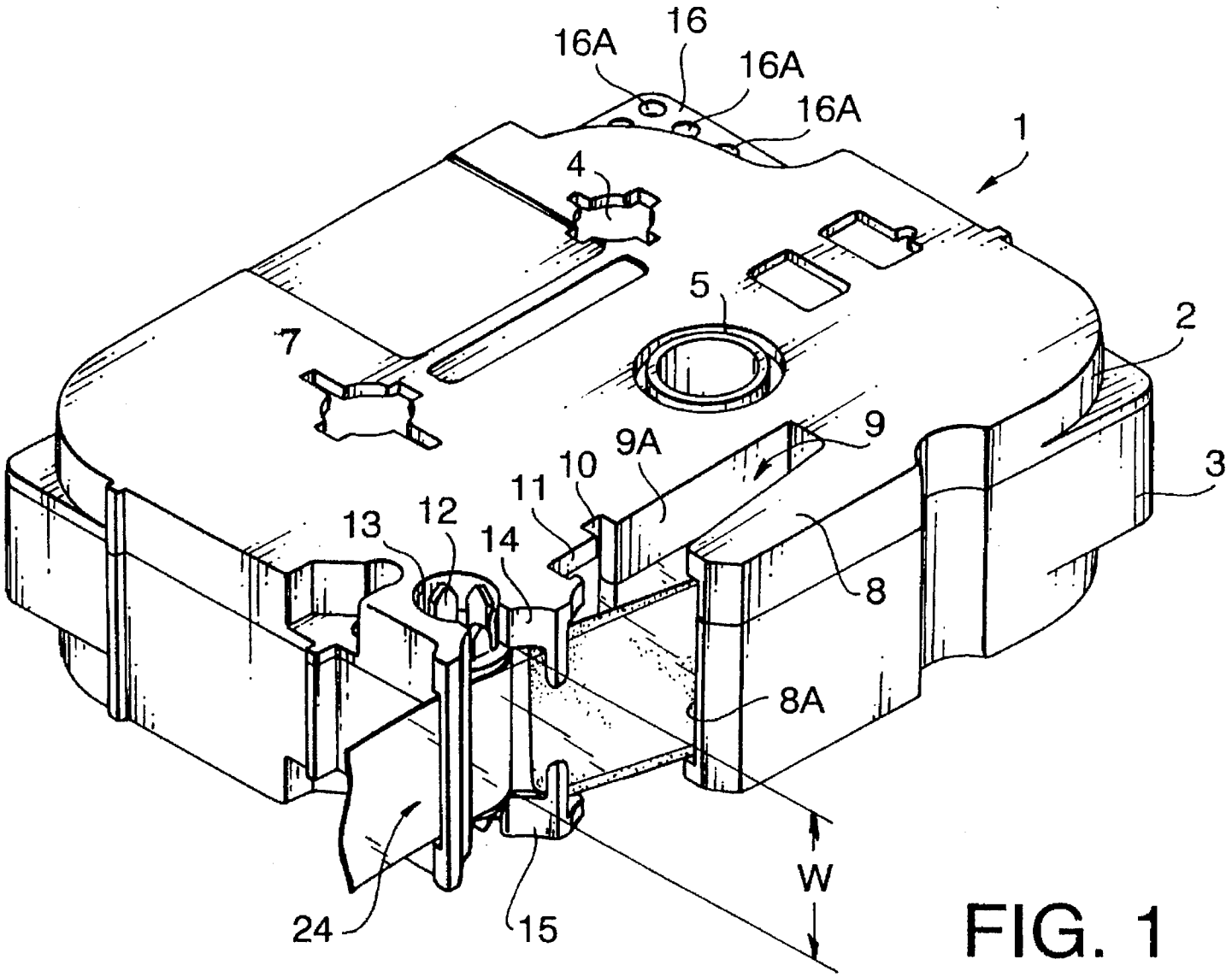
FIG. 1 is a perspective view of the tape cassette.
Figure 11:
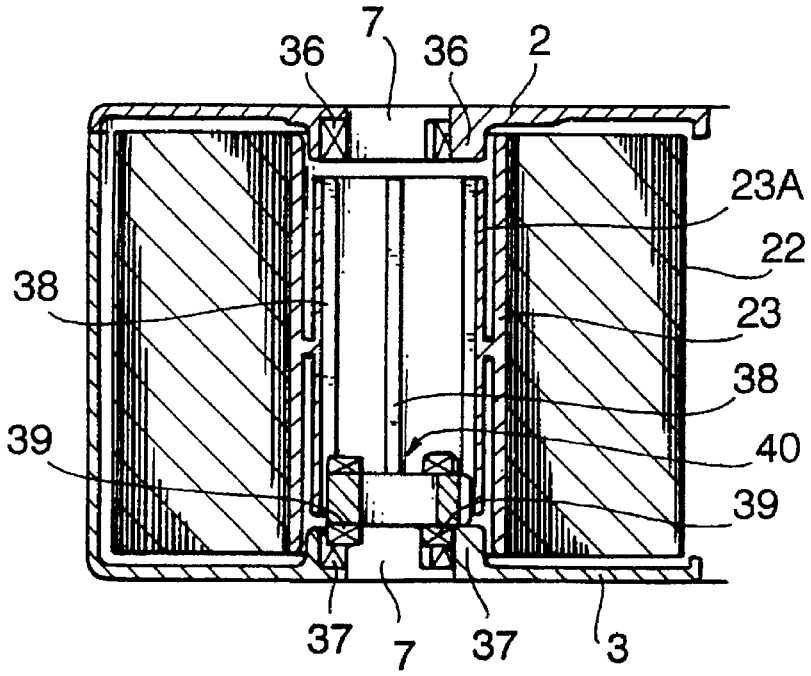
FIG. 11 is a sectional view showing an adhesive backing spool with the lower case of the tape cassette facing down.
Figure 12:
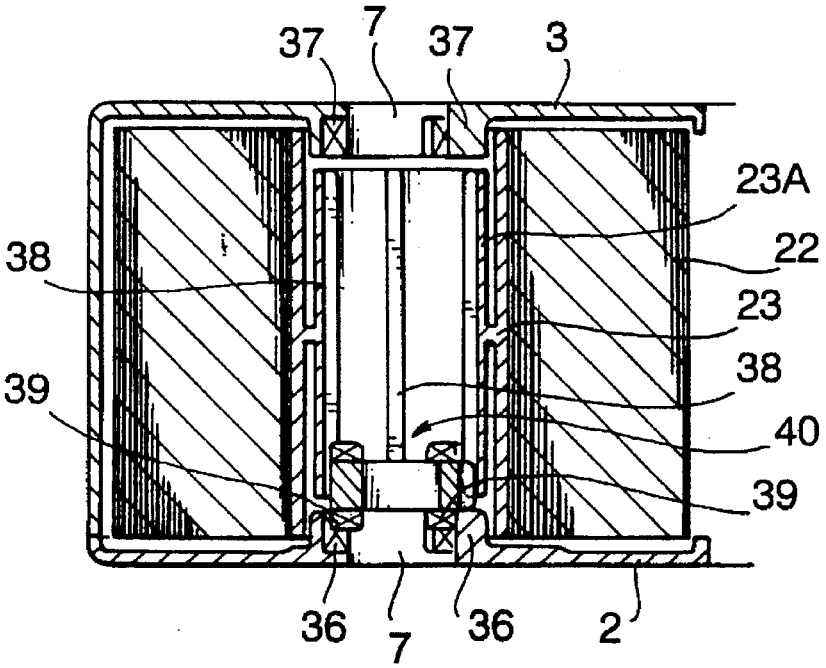
FIG. 12 is a sectional view showing the adhesive backing spool with the lower case of the tape cassette facing up.
Figure 13:
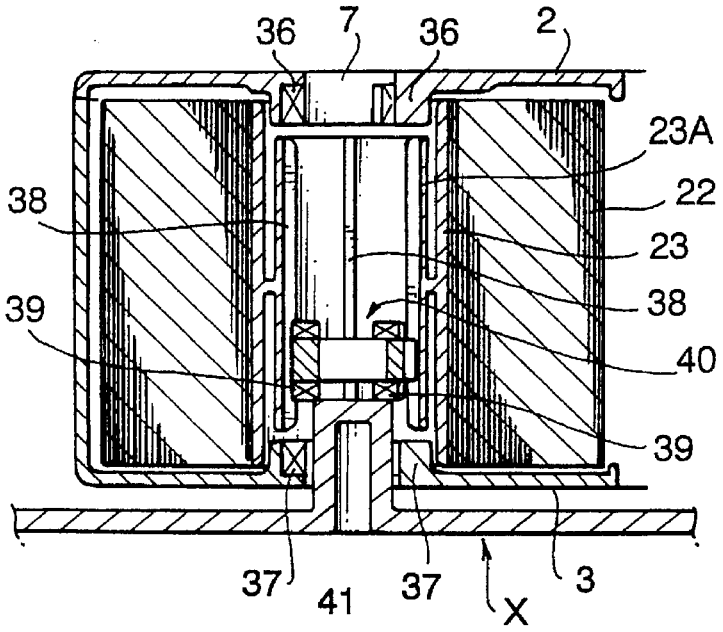
FIG. 13 is a sectional view showing a sliding lock piece with the tape cassette seated.

An embodiment of a tape cassette according to the invention is shown in FIG. 1. The tape cassette 1 comprises an upper case 2 and a lower case 3, joinable to form the cassette casing. Each of the upper case 2 and lower case 3 have formed therein: a supporting ring member 4, for rotatably supporting a tape spool 18; a winding spool support hole 5, for rotatably supporting a ribbon winding spool 21; a feed capstan support hole 13, for rotatably supporting a feed capstan 12; and a support ring member 7, for rotatably supporting an adhesive backing spool 23. Each of the supporting ring members 4 and 7 has a hole therethrough, and a toroid projection into the body of the tape cassette 1, rotatably supporting the respective spools 20 and 23 on the outer surface of the toroid projections. The toroid projections are shown in FIGS. 11 through 13 for the supporting ring members 7. The winding spool support holes 5, 5 rotatably support a hollow axis of the ribbon winding spool 21.

An arm portion 8 (constituting a guide portion of the present invention) is provided on the tape printing side (the near side in FIG. 1) of the tape cassette 1. The arm portion 8 guides a film tape 17, drawn out from the tape spool 18, and an ink ribbon 19, drawn out from the ribbon spool 20, and discharges the tape 17 and ribbon 19 from an opening 8A. A head mounting recess 9 at the rear side of the arm portion 8 accepts a thermal head H (shown in FIG. 20) of the tape printer P. A first coupling slot 10 (internally projected towards the rear side of the tape cassette 1) is formed in a wall portion 9A, opposing the arm portion 8 and the head recess 9. A second coupling slot 11 (internally projected perpendicular to the first coupling slot 10) is formed along the small portion 9A.

The feed capstan 12 is rotatably supported by the supporting hole 13 on the downstream side of the head mounting recess 9, in the feeding direction (of both the film tape 17 and the ribbon 19). The feed capstan 12 draws the film tape 17 from the tape spool 18 and the adhesive backing 22 from the backing spool 23, in cooperation with a facing pressing roller 49 (see FIG. 15) provided in the tape printer P, and presses the tape 17 and backing 22 together such that they adhere. A printing region of the cassette is defined just downstream along the path of the film tape 17 from the arm portion 8, where the thermal head H prints onto the film tape 17. The film tape 17 has images formed thereon by the time it arrives at the feed capstan 12, having passed the thermal head H and printing region.

Figure 2:
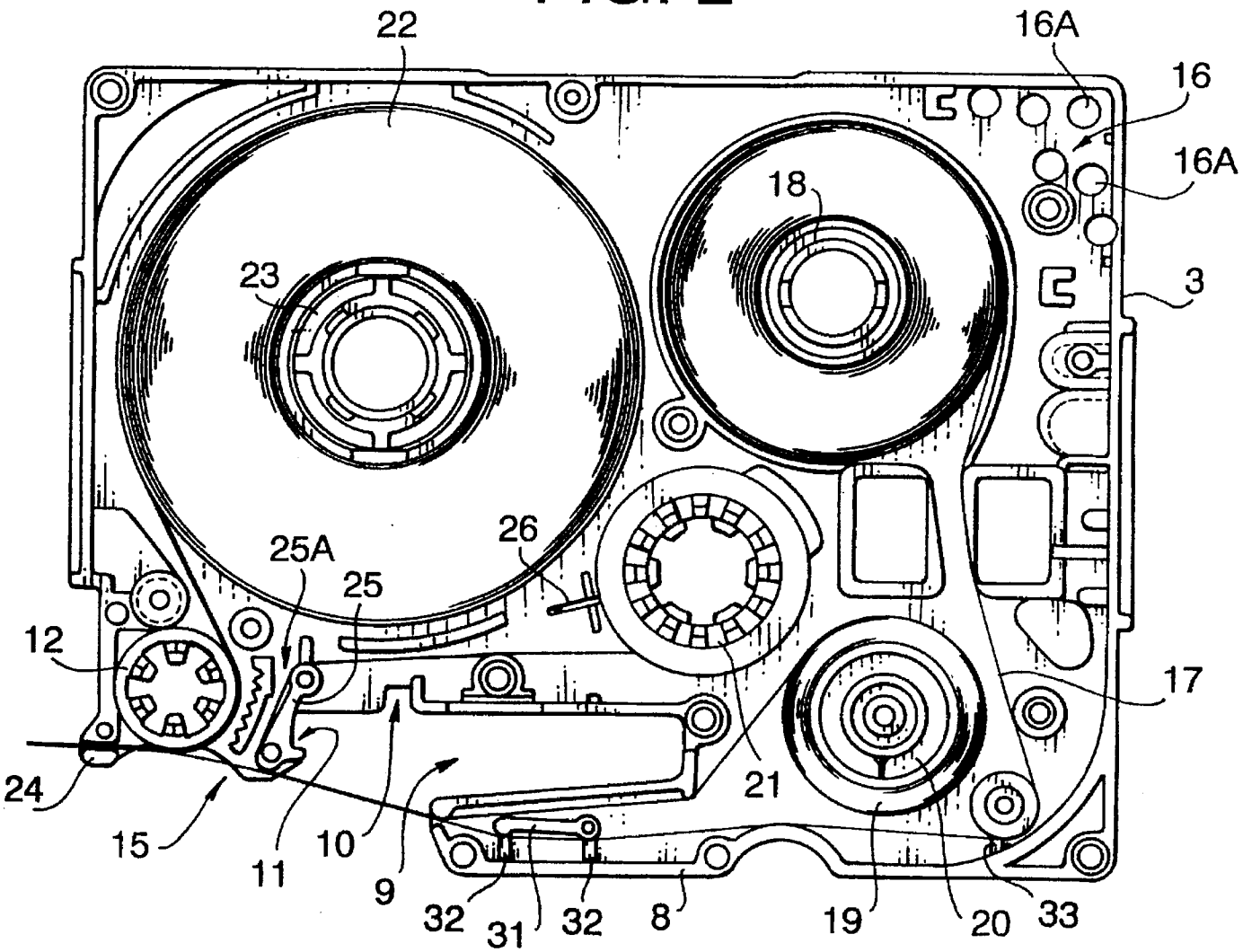
FIG. 2 is a plan view of the lower case, shown with the upper case removed.

FIG. 2 is a plan view showing the lower case 3 with the upper case 2 removed. The tape spool 18 is rotatably supported by the supporting ring member 4, and the ribbon spool 20 on which the ink ribbon 19 is wound is rotatably arranged. The ribbon winding spool 21 for drawing the fresh ink ribbon 19 from the spool 20, and for winding up the consumed ink ribbon 19, is rotatably arranged in the supporting hole 5 intermediate the tape spool 18 and the ribbon spool 20.

The ribbon winding spool 21 draws the ink ribbon 19 from the ribbon spool 20, and after the ribbon 19 passes through the opening 8A of the arm portion 8 and by the head mounting recess 9 and printing region, the ribbon 19 then enters the guide channel 25A of the guide channel wall 25 formed inside each respective regulating member 14 and 15 to be wound about the ribbon winding spool 21. A clutch spring 26 is attached at the bottom of the ribbon winding spool 21. The clutch spring 26 prevents the release of the ink ribbon 17 by reverse rotation of the ribbon winding spool 21.

The backing spool 23 is visible in FIG. 2. The adhesive backing 22 includes a double-sided adhesive tape and a peel-off tape, laminated and wound on the backing spool 23 with the peel-off tape facing outwards. The adhesive backing 22 is drawn from the backing spool 23 by the feed capstan 12 and the press roller 49 (provided to the tape printer P). When drawn from the spool 23, one of the adhesive sides of the adhesive tape portion of the backing tape is exposed, while the peel-off tape adheres to the other adhesive side of the adhesive tape portion. After the film tape 17 passes through the opening 8A of the arm portion 8 and the forward side of the head recess 9 (the printing region, at the lower intermediate side in FIG. 2), the exposed adhesive side of the backing 22 is adhered (laminated) to the image bearing surface of the film tape 17 by the feed capstan 12 and press roller 49, and thereafter the laminated tape 17 and backing 22 are discharged from the tape cassette 1 from a tape discharge slot 24. After severing the discharged and laminated tape, the peel-off tape can be peeled, exposing the laminated surface and allowing the printed tape to be stuck onto a surface.

Tape Printer

Figure 20:
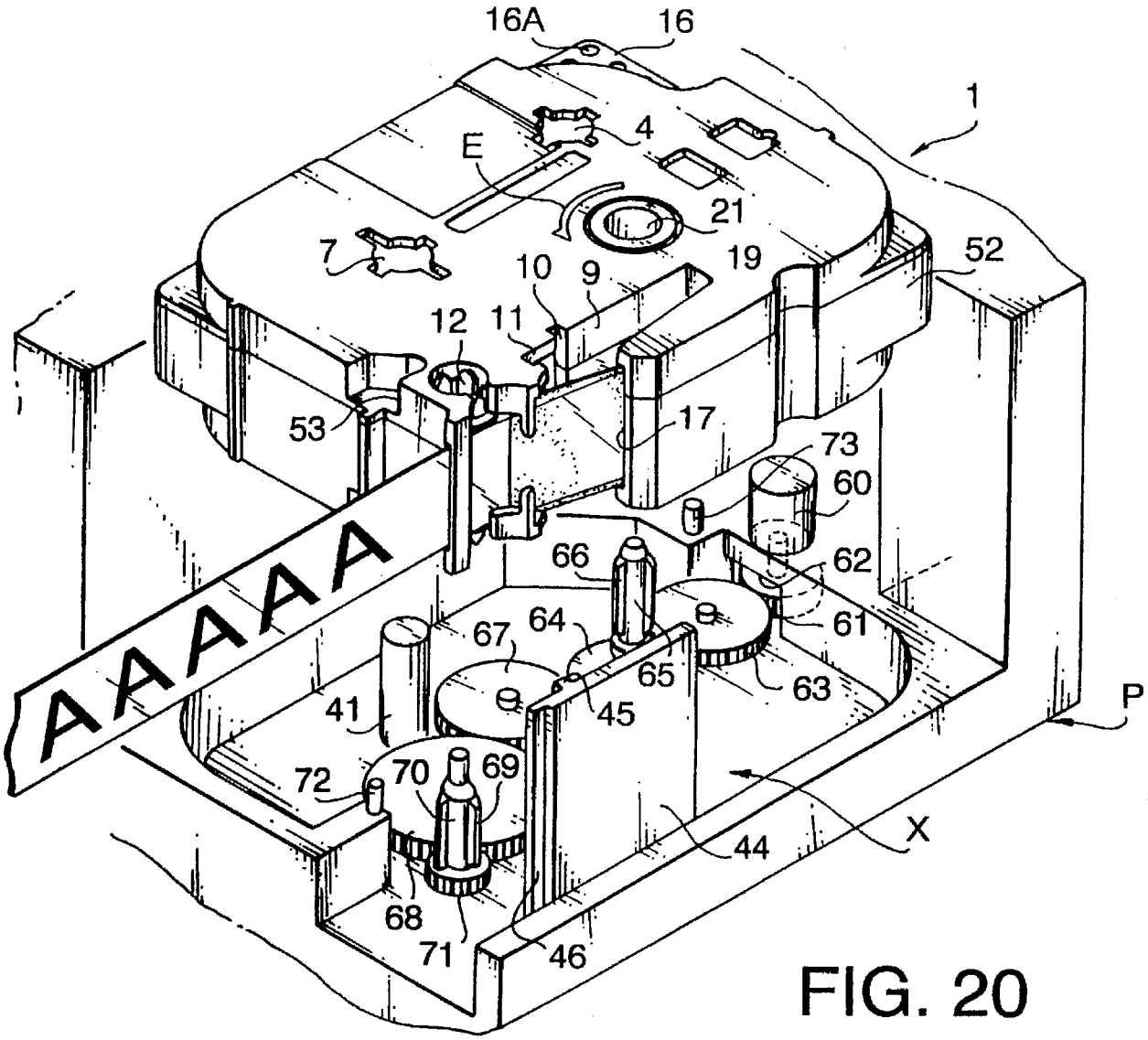
FIG. 20 is an explanatory view showing a front-loaded tape cassette.
Figure 22:
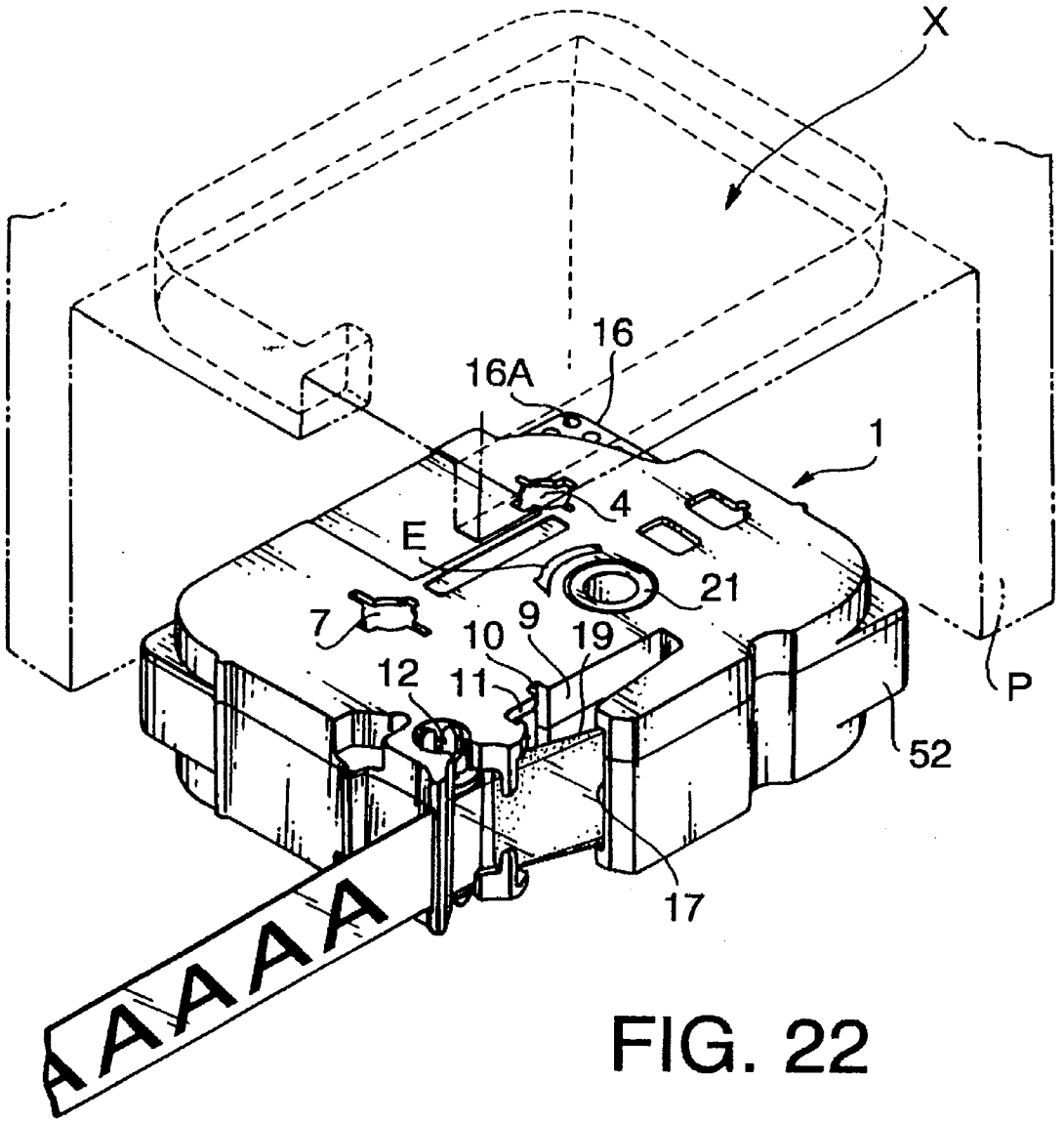
FIG. 22 is an explanatory view showing a bottom-loaded tape cassette.

FIG. 20 is an exploded view showing the internal structure of a front mounting cassette mount X of the tape printer P in which a tape cassette 1, according to the embodiment, may be seated. FIG. 22 shows an exploded view of a bottom mounting cassette mount X. The bottom mounting cassette mount X includes identical features to those of the front mounting cassette mount X described below, mirrored to engage with the cassette 1 from the upper side of the cassette 1, even though the features are not visible in FIG. 22. The following elements described are therefore also applicable to the bottom mounting cassettes mount X of FIG. 22, except where noted.

A drive motor 60 is arranged in the tape printer P on one lateral side of the cassette mount X (the right side in FIG. 20), and a drive gear 62 is secured at the lower end of the drive shaft of the drive motor 60. The drive gear 62 meshes with an intermediate gear 63 rotatably supported at the bottom surface of the cassette mount X (via an opening 62 formed in the side of the cassette mount X), and the gear 63 further meshes with a winding gear 64. A ribbon winding shaft 65 that drives the ribbon winding spool 21 is provided on the upper surface of the winding gear 64. Winding sprockets 66 (coupling to engaging ribs 30 of the ribbon winding spool 21, refer to FIG. 9) are provided around the ribbon winding shaft 65.

A second intermediate gear 67 meshes with the gear 64, and a third intermediate gear 68 meshes with the gear 67. A driven pinion 71, upon which a tape drive shaft 70 is provided, meshes to the gear 68. The tape drive shaft bears drive sprockets 69 (which engage the drive ribs 43 of the feed capstan 12, refer to FIG. 14).

Two positioning pins 72 and 73 are provided around the cassette mount X. The positioning pins 72 and 73 are inserted into pin holes 53 and 54 of the cassette 1 (refer to FIGS. 19A and 19B) to precisely position the tape cassette 1 within the cassette mount X.

As shown in FIG. 20, a head support 44 is fixedly provided to the front side of the cassette mount X. The head support 44 bears the thermal head H. A first coupling ridge 45, to be inserted into a first coupling slot 10 of the tape cassette 1, and a second coupling ridge 46, to be inserted into the second coupling slot 11 of the tape cassette 1, are provided on the head support 44. The first coupling ridge 45 extends vertically over the length of the head support 44, and when mated to the first coupling slot 10 of the tape cassette 1, locates the tape cassette 1 in the left-to-right direction. The second coupling ridge 46 extends vertically over the length of the head support 44 perpendicularly to the first coupling ridge 45, and when mated to the second coupling slot 11 of the tape cassette 1, locates the tape cassette 1 in the front-to-back direction.

Figure 15:
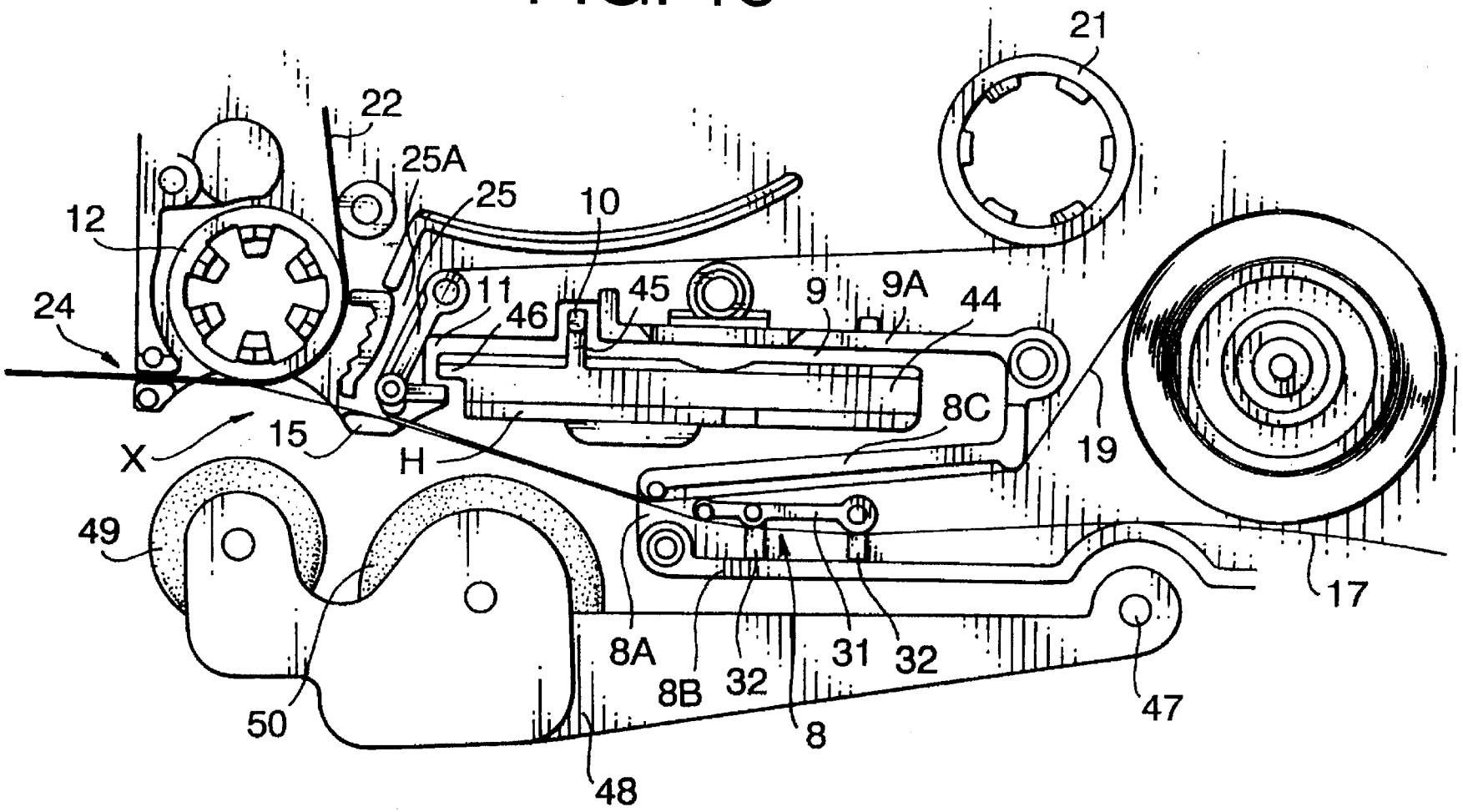
FIG. 15 is an enlarged explanatory view showing a head support, a thermal head, and a head mount with the tape cassette seated.

As shown in FIG. 15, a roller support 48, swingably supported about the supporting shaft 47, and opposing the tape cassette 1, is provided in the cassette mount X. A press roller 49 and platen roller 50 are rotatably supported by the roller support 48. The press roller 49 carries out the tape feed and lamination operations, cooperating with the feed capstan 12, as it is pressed against the feed capstan 12 with the film tape 17 and adhesive backing therebetween. The platen roller 50 is pressed against the thermal head H.

Figure 21:
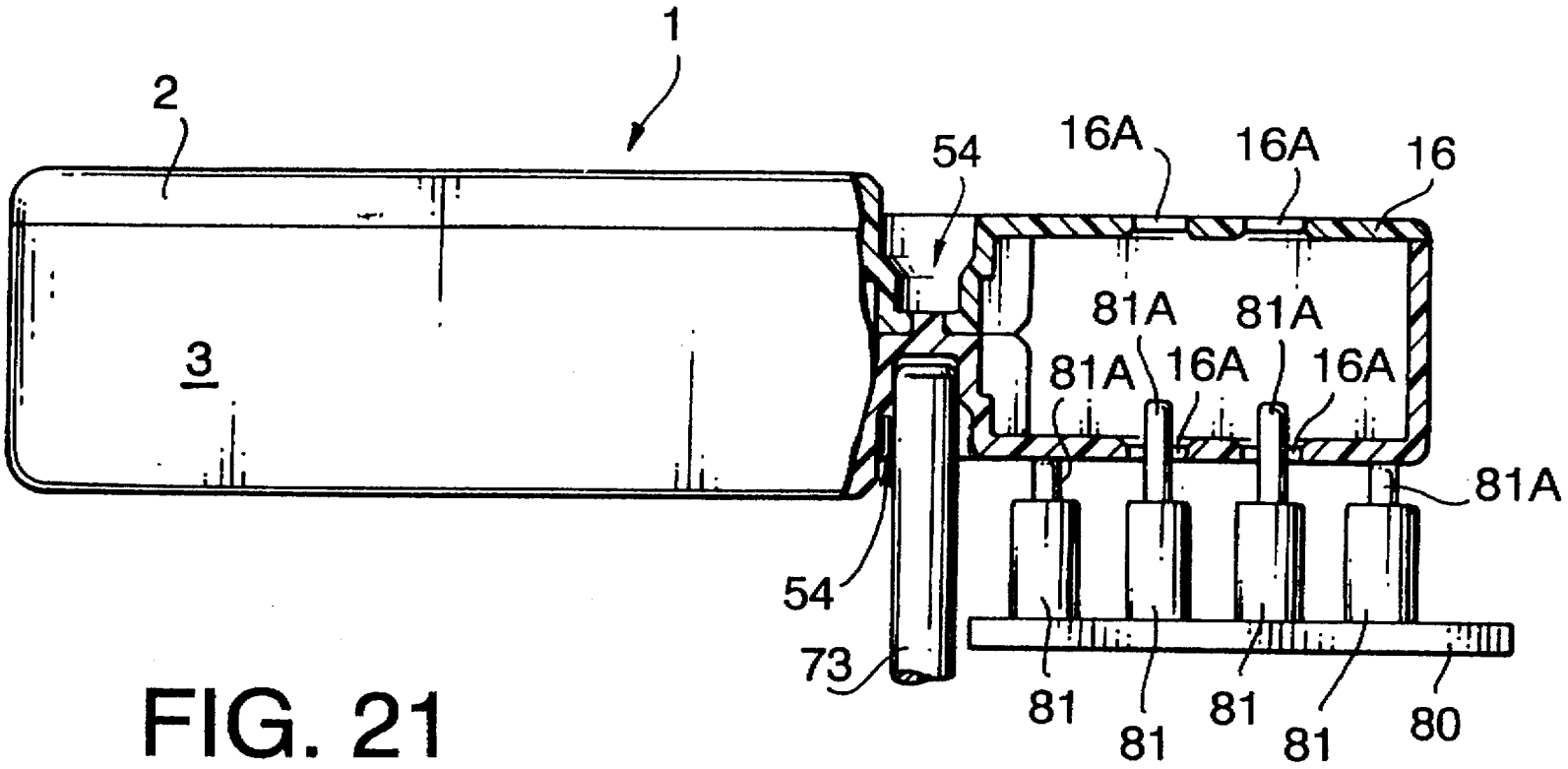
FIG. 21 is an explanatory view showing a code bank of holes and detecting switches for a front-loaded tape cassette.
Figure 23:
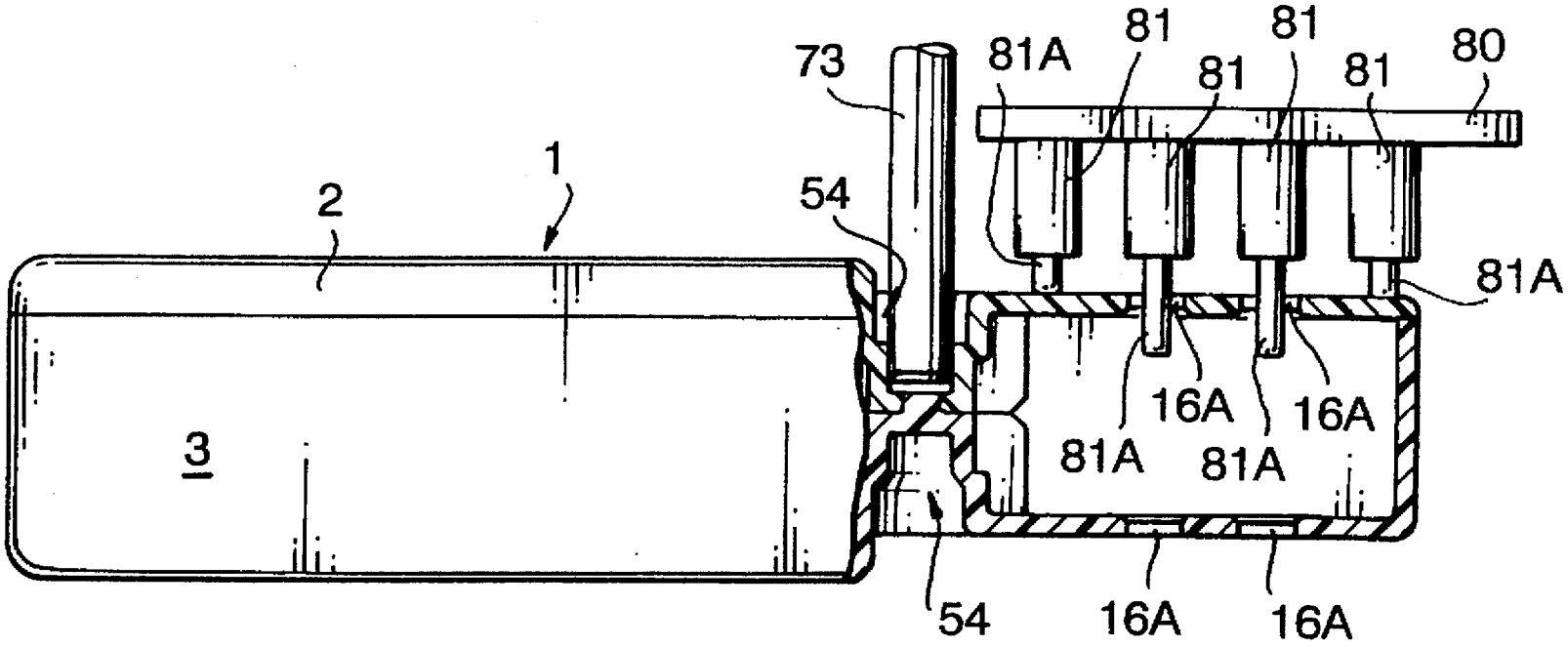
FIG. 23 is an explanatory view showing a cassette detection portion and a detecting switch for a bottom-loaded tape cassette.

An arrangement of detection switches 81 is provided in the cassette mount X to detect a binary code bank of holes on the cassette according to the embodiment. The detection switches 81 are shown in FIG. 21 and 23 for front and bottom loading cassette mounts X, respectively. As shown in FIGS. 21 and 23, at the rear of the cassette mount X, a switch supporting member 80 is arranged, and four detection switches 81 are arranged in parallel on this switch supporting member 80. In the front mounting cassette mount of FIG. 21, the switches 81 project upwardly, and in the bottom mounting cassette mount of FIG. 21, the switches 81 project downwardly. Each detecting switch 81 has a switch terminal 81A and each detecting switch 81 is maintained to be OFF under the condition that each switch terminal 81A not depressed (the terminal enters a switch hole 16A on the cassette 1, described later). On the other hand, at the portion where the switch hole 16A does not exist, the switch terminal 81A is depressed and thereby turned to ON. The switches 81 are provided to the cassette mount X in a predetermined pattern to match a pattern of switch holes 16A and blocked witch holes on the cassette 1. Based on the combination of ON and OFF of these detecting switches 81 the type of tape cassette 1 is detected.

A boss 41 (refer to FIG. 13) is provided in the cassette mount X, between the gears 67 and 68. The boss 41 pushes a sliding lock piece 40 upwardly in the backing spool 23 when the cassette 1 is seated in the cassette mount X of the tape printer. In the case of the bottom mounting cassette mount of FIG. 22, if the cassette 1 is oriented as shown in FIG. 22 during operation, the boss 41 is provided to a lid member (not shown) that closes the cassette mount X, and protrudes upwards into the cassette mount X volume.

Head Coupling

FIG. 15 is an enlarged explanatory view showing a relationship between a head support (supporting the thermal head H) and the head recess 9 (corresponding to the printing region of the cassette 1) when the tape cassette 1 is seated in the cassette mount X of the tape printer P.

A first coupling slot 10 is provided as a groove inside the head recess 9 on an inner wall, and extends vertically over the length of the inner wall. The first coupling slot 10 is mated to the first coupling ridge 45 on the head support 44 of the tape printer when the tape cassette 1 is seated. Furthermore, a second coupling slot 11 is provided as a groove inside the head recess 9 on an inner wall perpendicular to that of the first coupling slot 10, and extends vertically over the length of the inner wall. The second coupling slot 11 is mated to the second coupling ridge 46 on the head support 44 of the tape printer when the tape cassette 1 is seated.

To seat the tape cassette 1 in the cassette mount X and locate the thermal head H of the printer in the printing region of the cassette, the coupling slots 10 and 11 of the tape cassette 1 are aligned with the coupling ridges 45 and 46, respectively, of the head support 44. Then, the tape cassette 1 is pressed into the cassette mount X from above. The tape cassette 1 is thereby aligned in right and left directions by means of the first coupling slot 10 and the first coupling ridge 45, and in front and rear directions by means of the second coupling slot 11 and the second coupling ridge 46. Therefore, it is always possible to seat the tape cassette 1 in a predetermined position with reference to the cassette mount X. Accordingly, the film tape 17 and the ink ribbon 19, exposed at the head recess 9, cannot contact the thermal head H on the head support 44 (until the platen roller 50 is applied). It is therefore possible to seat the tape cassette 1 precisely and easily to the cassette mount X by means of the coupling slots 10, 11 and ridges 45, 46.

Arm Guiding Structures

Figure 10:
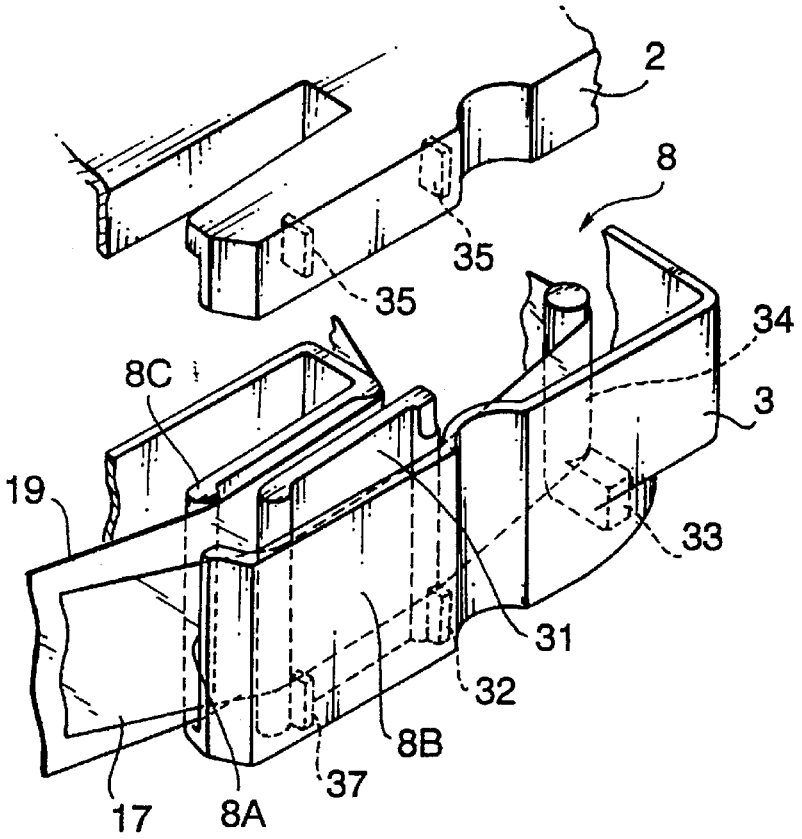
FIG. 10 is an exploded perspective view showing an arm portion.

The guiding structure of the arm portion 8 for the film tape 17 and ink ribbon 19 is shown in FIG. 10. The arm portion 8 of the lower case 3 includes an outer wall 8B and inner wall 8C. The outer wall 8B extends to the external wall of the lower case 3, and the external wall of the lower case 3 continues at the same height as the outer wall 8B all around the lower case 3, excepting the inner wall 8C. The inner wall 8C is set to be higher than the outer wall 8B, and substantially the same height as the ink ribbon 19 width. A partition wall 31 is provided between the outer wall 8B and the inner wall 8C, and the partition wall 31 is set to be substantially the same height as the inner wall 8C and ink ribbon 19 width. A matched pair of guide regulating pieces 32, 35 and 32, 35 are formed at each of the exit and entry sides of a film tape feed path between the partition wall 31 and outer wall 8B. The lower regulating pieces 32 are formed at the base of the partition wall 31, and the upper regulating pieces 35, 35 are formed on the upper case 2 in a portion which forms the upper side of the arm portion 8, positioned opposite to the respective regulating pieces 32, 32. A guide pin 34, having a bottom regulating piece 33 at its lower end, is provided upstream of the partition wall 31 in the lower case 3.

The film tape feed path (defined by the outer wall 8B, the partition wall 31, and the guide pin 34) and a ribbon feed path (defined by the inner wall 8C and the partition wall 31) are formed within the arm portion 8, the tape cassette 1 being structured as the joined upper case 2 and lower case 3. The feeding direction of the film tape 17 turns at the guide pin 34, the lower end thereof being regulated by the regulating member 33. The film tape is subsequently fed and guided between the outer wall 8B and the partition wall 31 (within the arm portion 8) and guided and regulated in the tape width direction by the lower regulating pieces 32, 32 and upper regulating pieces 35, 35. The ink ribbon 19 is fed and guided between the inner wall 8C and the partition wall 31 (within the arm portion 8) and guided by the inner wall 8C and the partition wall 31 (the partition wall 31 and inner wall 8C having substantially the same height as the ribbon 19 width). The ink ribbon 19 is regulated in the width direction by means of the lower surface of the upper case 2 and the upper surface of the lower case 3. The regulation of the film tape 17 by the regulating pieces 33, 32, 32, 35, 35 (placed only in the tape feed path) in the width direction places the tape 17 approximately in the center of the width of the wider ink ribbon 19, such that a portion of the ink ribbon 19 is exposed on both sides of the film tape 17 in the width direction. The film tape 17 overlaps and covers the remaining center portion of the ink ribbon 19 when the film tape 17 and the ink ribbon 19 are in the printing region.

If the ribbon 19 and tape 17 were to have different widths, but be fed and guided along the same path, independent regulation in the width direction would be impossible. However, although the ink ribbon 19 is wider than the film tape 17, the film tape feed path and ink ribbon feed path are separated by means of the partition well 31, the film tape 17 and the ink ribbon 19 can be independently and precisely fed and guided, in their respective feed paths. Furthermore, as the ink ribbon 19 is fed and guided by the inner wall 8*c* and the partition wall 31, the ink ribbon 19 can be placed entirely in the lower case, so that the ink ribbon 19 does not become wrinkled or nipped at the joint between the cases 2 and 3 when the tape cassette is assembled. Moreover, when making a tape cassette 1 to print wider tapes, in the lower case 3, the height of only the guide and regulating portions in the lower case 3 need be increased, in accordance with the width of the selected ink ribbon 19 and tape 17. Advantageously, necessary increases in height of the outer wall 8B and associated parts, to adjust for the wider ribbons 19 and tapes 17 may be balanced between the two cases 2 and 3. It is unnecessary to increase the overall height (depth) of the lower case 3 (to correspond to the increased height of the inner wall 8C and partition wall 31), avoiding difficulties in molding associated with forming deep, thin-walled shells.

Regulating Members

Figure 16:
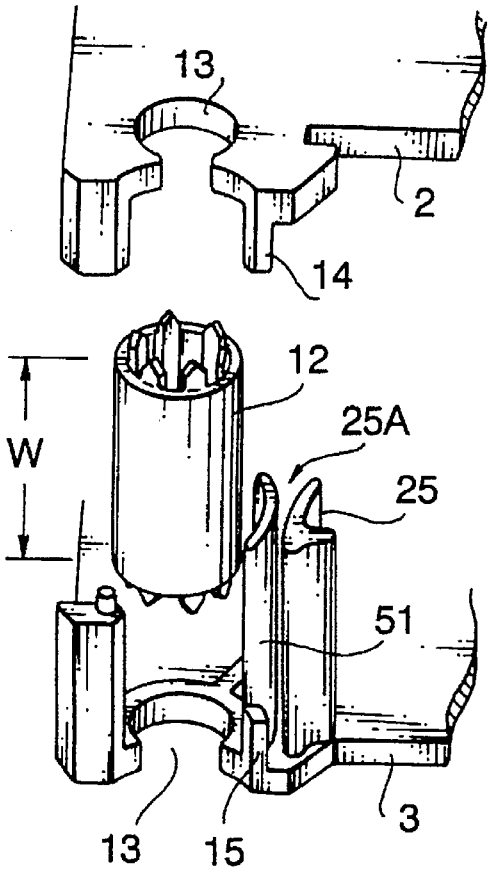
FIG. 16 is an exploded perspective view showing the vicinity of the feed capstan.
Figure 17:
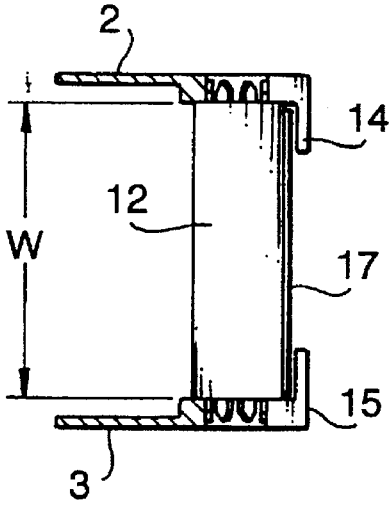
FIG. 17 is a side section view of the feed capstan.

FIG. 16 is an exploded perspective view showing the constitution of the feed capstan 12 and its surroundings. FIG. 17 is a side sectional view of the feed capstan 12. The regulating members 14, 15 are formed upstream of the feed capstan 12. A regulating wall 51 is provided on the lower case 3 adjacent the feed capstan support hole 13, and a guide wall 25 is provided adjacent to the regulating wall 51; a guide channel 25A is thereby formed between the regulating wall 51 and the guiding wall 25. When a tape cassette 1 is assembled by joining the upper case 2 and lower case 3, the width W (refer to FIG. 1) between the lower end of the upper regulating member 14 and the upper end of the lower regulating member 15 is set to be the same as the tape width of the film tape 17 and that of the adhesive backing 22. The face width (tape feeding surface) W of the feed capstan 12 is set to be the same as the width W between the regulating members 14, 15. The regulating members 14, 15 are upstream from the feed capstan 12 in the feed path for the film tape 17.

After the film tape 17 is printed, the ink ribbon 19 consumed by printing is wound up by the ribbon winding spool 21, and the film tape 17 is fed in the discharge direction by means of the feed capstan 12 and the press roller 49. At this time, as ink ribbon cannot advance between the respective regulating members 14, 15, but rather is wound up by the ribbon winding spool 21 through the guide groove 25A. The film tape 17 is fed to the feed capstan 12, regulated and guided in the tape width direction by the regulating members 14, 15, while the double-sided adhesive backing 22 is simultaneously fed to and adhered to the film tape 17, aligned with the tape feed width W of the feed capstan 12. The film tape 17 and double-sided adhesive backing 22 are thereby able to properly adhere, without displacement therebetween, in cooperation with the feed capstan 12 and the press roller 49. Thus, the film tape 17 is regulated by the regulating members 14, 15 in the width direction to be aligned with the feeding face of the feed capstan 12, having the same width as the film tape 17; the adhesive backing 22 is aligned with the feeding face of the feed capstan 12, and the adhesive backing 22 and film tape 17 are thereby fed and aligned together as the feed capstan 12 advances.

As shown in FIGS. 1, 16, and 17, the upper and lower regulating members 14 and 15 are provided downstream, in the feed path, from the printing region where the thermal head H prints images onto the film tape 17 via the ink ribbon 19. The regulating members 14 and 15 guide the printed film tape 17 in the width direction, so that the film tape 17 and the adhesive backing 22 are not misaligned and adhere properly.

The width of the ink ribbon 19 is as shown in FIG. 1, that is, wider than the width of the film tape 17. The width difference enables (a) positive separation of the film tape 17 from the ink ribbon 19 upstream of the regulating members 14 and 15, and (b) prevention of the escape of the ink ribbon 19 to the region downstream of the respective regulating members 14 and 15. That is, the width W sat between the perspective regulating members 14 and 15 is substantially the same width as the tape width of the film tape 17, and therefore, less than the width of the ink ribbon 19. Thus, at the time when the ink ribbon 19 is fed into and guided by the guide channel 25A of the guide portion 25, as the width between the regulating members 14, 15 is less than the width of the ink ribbon 19, the ribbon 19 cannot intrude between the regulating members 14, 15. Consequently, even if the ribbon 19 tends to follow the film tape 17, the ribbon 19 cannot continue downstream of the regulating members 14, 15. Thus, the ink ribbon 19 is never inadvertently drawn out downstream of the regulating members 14, 15 upon the feeding of the film tape 17. Thus, the embodiment of a cassette 1 cannot be rendered unusable by the type of jamming wherein the ink ribbon 19 adheres to the adhesive backing 22 after being inadvertently drawn out, following the film tape 17. Furthermore, when images are consecutively and steadily printed on the full printing width of the film tape 17 (for example, in printing negative characters on an inked background), then the ribbon 17 can be weakened in the printed areas. If the ink ribbon 19 is wider than the film tape 17 as described herein, then the ribbon 19 is naturally wider than the printable width of images. Since a non-used portion remains at both sides of the width of the ink ribbon 19, the ability of the ribbon to resist breaking when weakened is increased. The film tape 17, the adhesive backing 22, and the characters printable on a particular tape type are set to be the same width.

Ribbon/Tape Anchor

Methods of anchoring a trailing end portion of the film tape 17 to the tape spool 18 (and/or the ink ribbon 19 to the ribbon spool 20) are shown in FIGS. 3 through 8. Although the film tape 17 is shown anchored to the tape spool 18 in FIGS. 3 through 8, the ink ribbon 19 is preferably anchored to the ribbon spool 20 in the same manner. Hence, reference numerals pertinent to the ink ribbon 19 and ribbon spool 20 appear in FIGS. 3 through 8 in parenthesis; the description given for the application of an anchoring method for the tape 17 to the spool 18 is analogous and equally applicable to the ribbon 19 and spool 20.

Figure 3:
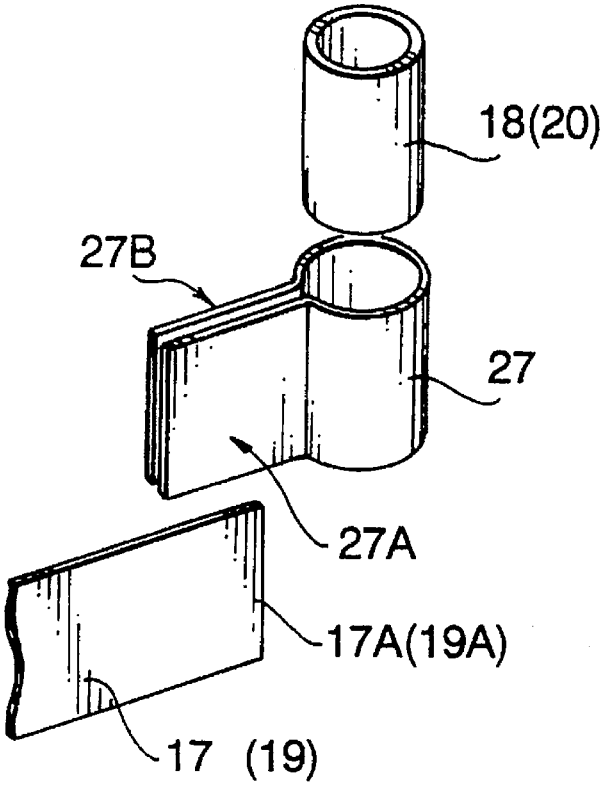
FIG. 3 is an exploded perspective view of a spool, schematically showing a first method to anchor a tape to the spool.
Figure 4:
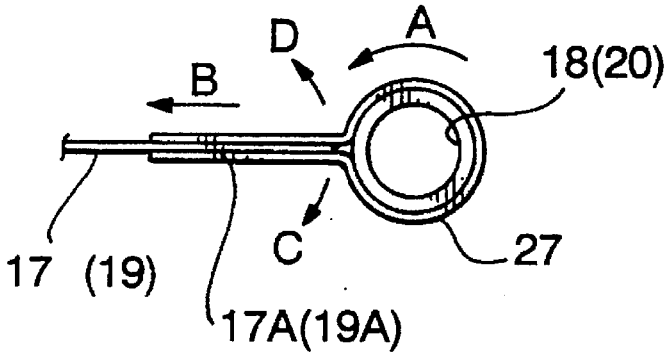
FIG. 4 is an exploded perspective view of the spool, schematically showing a second method to anchor a tape to the spool.

In FIGS. 3 and 4, a trailing end 17A of the film tape 17 is anchored to the tape spool 18 by adhering and fixing the trailing end 17A between two end portions 27A and 27B of an adhesive band 27, and adhering the trailing end 17A to both end portions 27A and 27B. The adhesive band 27 is wound and adhered as a loop around the tape spool 18.

In FIG. 4, the tape spool 18 is rotated, for example, in the direction A. A pulling force is applied in the direction of the arrow B on the film tape 17, under the condition that the film tape 17 is just anchored to the tape spool 18. The pulling force B acts as a force to releasing the adhesive band 27 from the tape spool 18. More particularly, it acts as a force to overcome the shearing resistance of the overall surface of adhesion between the two adhered sides 27A, 27B and the spools 18 via components of the pulling force in the directions of the arrows C and D. As the adhesive band 27 is adhered both to the trailing end 17A and as a loop around the tape spool 18, the trailing end 17A of the film tape 17 is secured to the tape spool 18 with sufficient rigidity to resist the force to peal the adhesive band 27 from the tape spool 18 or from the trailing end 17A.

Figure 5:
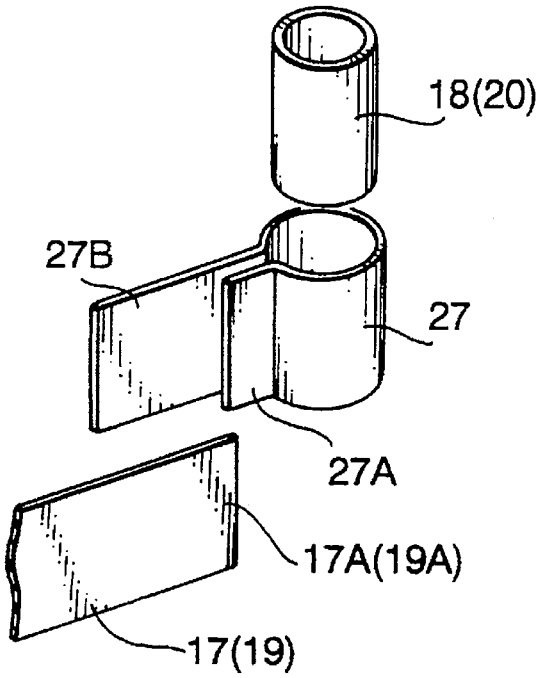
FIG. 5 is an exploded perspective view of the spool, schematically showing a third method to anchor a tape to the spool.
Figure 6:
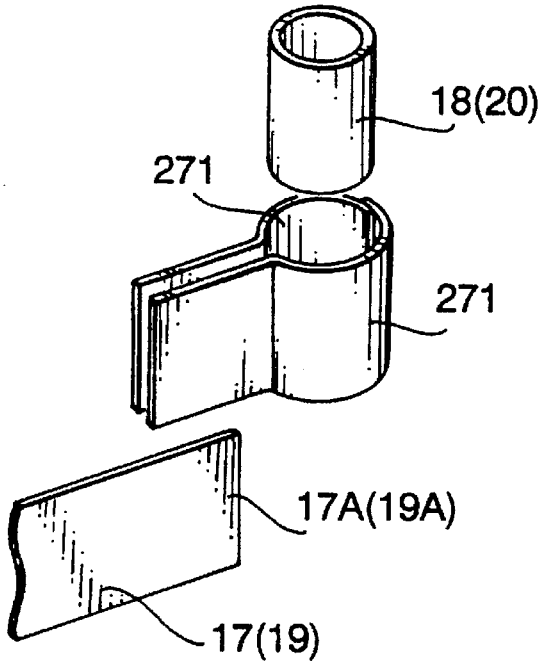
FIG. 6 is an exploded perspective view of the spool, schematically showing a fourth method to anchor a tape to the spool.
Figure 7:
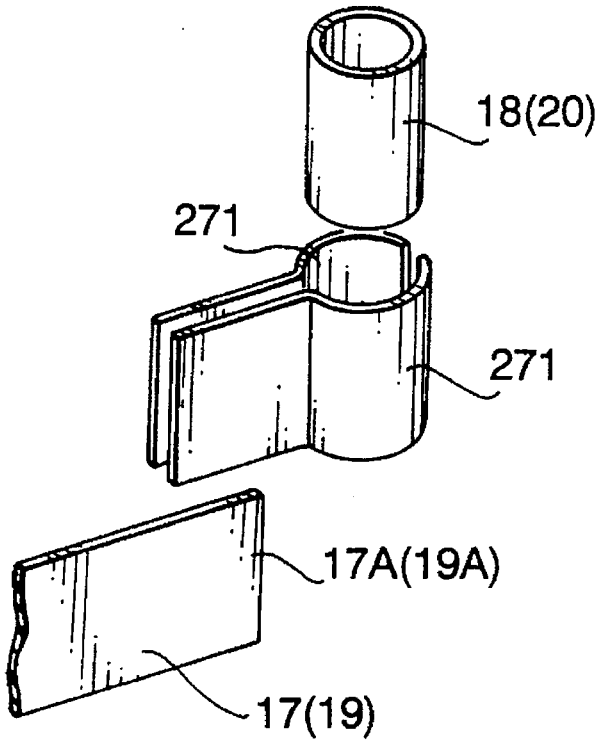
FIG. 7 is an exploded perspective view of the spool, schematically showing a fifth method to anchor a tape to the spool.
Figure 8:
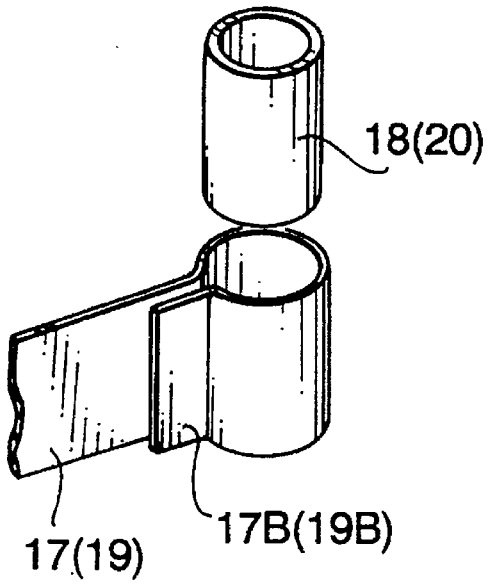
FIG. 8 is an exploded perspective view of the spool, schematically showing a sixth method to anchor a tape to the spool.

Alternatively, the film tape 17 is anchored to the tape spool 18 as illustrated in FIGS. 5 through 8. FIG. 5 shows an anchoring method wherein one end portion 27B of the adhesive band 27 is elongated, and the trailing end 17A of the film tape 17 is adhered to the end portion 27B, while the remaining end portion 27A of the adhesive band is also adhered to the end portion 27B, but closer to the spool 18. In another alternative, represented by FIGS. 3 and 5, an adhesive band 27, of which the portion for winding the tape spool 18 does not have adhesive agent, and only end portions 27A, 27B carry an adhesive agent, each used for anchoring. FIG. 6 shows an anchoring method wherein the adhesive band constitutes two sheets 271, 271; when wound and adhered to the tape spool 18, the respective adhesive sheets 271 partly overlap each other opposite the connection point of the trailing end 17A, and the trailing end 17A is adhered to both adhesive sheets 271, 271. FIG. 7 shows a similar anchoring method as in FIG. 6, but the respective adhesive sheets 271 are not overlapped opposite the connection point of the trailing end 17A. FIG. 8 shows a anchoring method wherein the adhesive band is formed unitarily with the tape 17, and is looped about the spool 18 and adhered to itself at an adhesive-coated trailing end 17B.

When any of the above-mentioned anchoring methods are employed, it is possible to securely anchor the trailing end 17A of the film tape 17 to the tape spool 18 via the adhesive band 27. Using the same technique, it is possible to securely anchor the trailing end 19A of the ink ribbon 19 to the ribbon spool 20 via the adhesive band 27.

Lockable Backing Spool

FIG. 11 is a sectional view showing the backing spool 23 when the tape cassette 1 is oriented with the upper case 2 facing upwards, and FIG. 12 is a sectional view showing the backing spool 23 when the tape cassette is oriented with the lower case 3 facing upwards.

As shown in FIG. 11, a plurality of engaging ribs 36 radiate inwards from the center of the cassette-internal end of the supporting ring member 7 of the upper case 2, and similar engaging ribs 37 are provided to the supporting ring member 7 of the lower case 3. The backing spool 23 has a dual-wall construction, and four sliding grooves 38 are formed in a vertical direction in the inner wall 23A thereof. Each one of these four sliding grooves 38 is formed in an axial direction at 90 degree intervals about the inner wall 23A.

A cylindrical sliding lock piece 40, which slides vertically in the sliding grooves 38, is inserted in the backing spool 23. The sliding lock piece 40 bears four sliding protrusions 39 that engage and slide relative to the grooves 38. Each sliding protrusion 39 is also engageable with the engaging ribs 36 or 37, according to the orientation of the tape cassette 1. When the tape cassette 1 is upper case facing upwards (FIG. 11) the protrusions 39 engage both the grooves 38 and the engaging ribs 37 of the lower case 3; when the tape cassette 1 is reversely arranged with the lower case facing upwards (FIG. 12) the protrusions 39 engage both the grooves 38 and the engaging ribs 36 of the upper case 2. When the sliding protrusions 39 of the sliding lock piece 40 are disengaged from both sets of the engaging ribs 36 and 37, the sliding lock piece 40 rotates together with the backing spool 23 due to the engagement with the grooves 38. If the protrusions 39 engage either of the sets of engaging ribs 36 or 37, the backing spool 23 is locked from rotating within the tape cassette 1 due to the simultaneous engagement with the grooves 38. The sliding lock piece 40 can be displaced to a non-locking position by a boss 41 provided in a cassette mount X of a tape printer P.

FIG. 13 is a sectional view showing the state of the sliding lock piece 40 when the tape cassette 1 is seated in the cassette mount X with the lower case 3 facing downwards and upper case 2 facing upwards. In FIG. 13, a boss 41 is disposed in the cassette mount x of the tape printer P, in alignment with the supporting ring member 7 of the tape cassette 1. The boss 41 projects into the supporting ring member 7 of the lower side 3 when the tape cassette 1 is seated. Alternatively, a boss 41 is provided in a cassette mount X where the upper side 2 faces downwards, projecting into the supporting ring member 7 of the upper case 2. Further alternatively, the boss 41 is provided on a lid of the cassette mount X in either case, and the lid is on the bottom of the tape printer P when in an operating position. In any of these cases, FIG. 13 is representative of the operating position.

When the tape cassette 1 is seated, the boss 41 projects sufficiently far into the ring member 7 to enter the center of the backing spool 23, and therefore to push up the sliding lock member 40. Consequently, the engagement of the sliding protrusions 39 to the engaging ribs 37 is released, and the backing spool 23 becomes rotatable together with the sliding lock piece 40. Subsequently, the adhesive backing 22 can be drawn out from the backing spool 23, and the normal tape forming operation becomes possible.

In this manner, when the tape cassette 1 is removed from the cassette mount X of the tape printer P, the rotation of the backing spool 23 is locked when the sliding protrusions 39 engage the engaging ribs 36 or 37. Thus, it is difficult to unintentionally draw the adhesive backing 22 from the tape cassette 1 or for the adhesive backing 22 to be taken into the inside of the tape cassette 1. Similarly, since the tape 17 is adhered to the adhesive backing 22 at the feed capstan 12 and downstream, it is difficult to draw the tape 17 or laminated tape 17 and backing 22 from the cassette. However, when the tape cassette 1 is seated in the cassette mount X of the tape printer P, the backing spool 23 can be freely rotated to carry out the tape forming operation.

Front/Bottom Loading

The tape cassette 1 can be seated in a tape printer P having a cassette mount X (FIGS. 13, 20, and 21) provided in an top surface or a bottom surface. When seated in an top surface mount X, the cassette is seated on the lower case 3 side, called a "front loading system". When seated in a bottom surface mount X, the cassette is seated on the upper case 2 side, called a "bottom loading system". The tape cassette 1 according to the present embodiment has various characteristic structures and mechanisms to allow application to either of the front or bottom loading systems, as explained hereinafter.

Figure 14A:
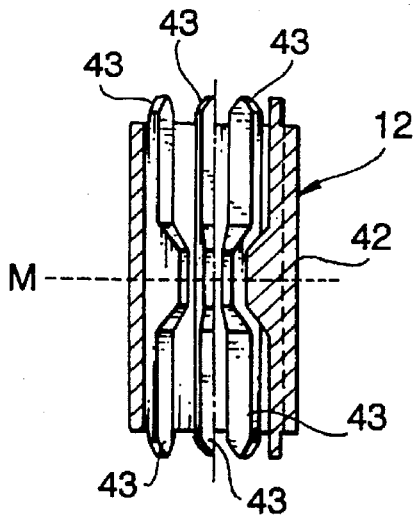
FIG. 14A is a sectional view of a feed capstan.
Figure 14B:
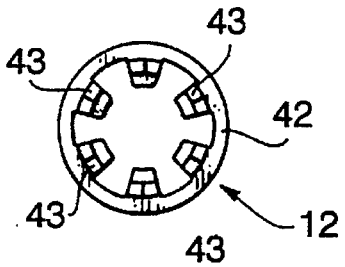
FIG. 14B is a plan view of the feed capstan.

The feed capstan 12 is shown in a sectional view in FIGS. 14A and in a plan view in FIG. 14B. The feed capstan 12 includes a cylindrical portion 42, made of a plastic material and a plurality of longitudinal drive ribs 43 projecting inward radially from the inner wall of the cylindrical portion 42, evenly distributed about the inner surface of the cylindrical portion. A vertically central position of the cylindrical portion 42 is indicated in FIG. 14A by a broken line M. The drive ribs 43 are vertically symmetrically formed on both sides of the central position M.

Drive sprockets 69 of the tape drive shaft 70 (shown in FIG. 20), provided on the cassette mount X of the tape printer P engage the drive ribs 43 of the feed capstan 12. The feed capstan 12 is thereby rotated by the tape drive shaft 70. The feed capstan thereby 12 adheres the adhesive backing 22 to the film tape 17, in cooperation with the press roller 49 (shown in FIG. 15). The tape drive shaft 70 and feed capstan 12 carry out the feeding operation, feeding (while simultaneously laminating) the adhesive backing 22 and tape 17 out of the tape cassette 1 through the tape discharge portion 24.

As the drive ribs 43 are vertically symmetrical on both sides of the central position M, in either of front loading (wherein the tape drive shaft 70 is inserted from the bottom of the feed capstan 12), and bottom loading (wherein the tape drive shaft 70 is inserted from above the feed capstan 12), the drive sprockets 69 of the tape drive shaft 70 can be engaged with the respective drive ribs 43.

Figure 9:
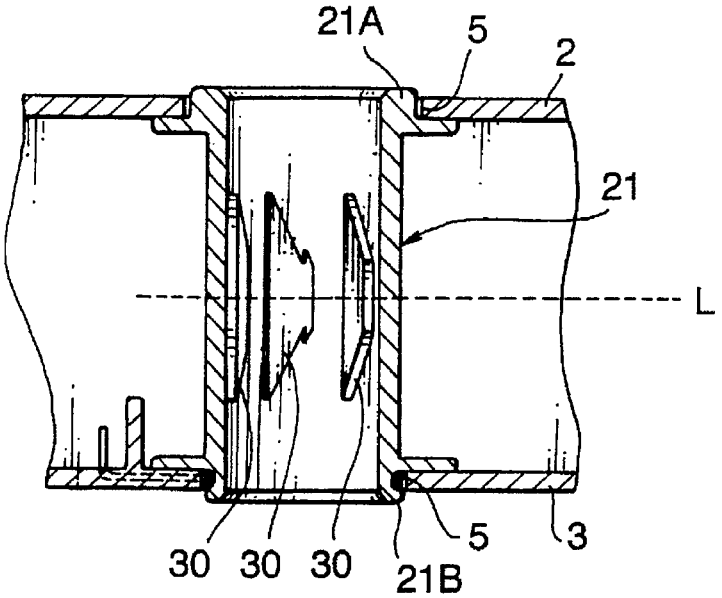
FIG. 9 is a sectional view of a ribbon winding spool.

The ribbon winding spool 21 is shown in section in FIG. 9. The ribbon winding spool 21 rotates in the same direction (refer to FIGS. 20 and 22) in either of front or bottom loading. The trapezoidal shape of each engaging rib 30 is oriented in the rotary direction of the seating direction of the ribbon winding spool 21. If inverted when assembled within the cassette 1, the ribbon winding spool 21 is unable to rotate normally. As a countermeasure, the diameter of the supporting hole 5 in the upper case 2 is set to be larger than the diameter of the supporting hole 5 of the lower case 3; The outer diameter of the upper spool hub 21*a* is also set to be larger than the outer diameter of the lower spool hub 21*b*, and upper spool hub 21*a* will only couple with the supporting hole 5 in the upper case 2. By adopting such a construction, the ribbon winding spool 21 is always correctly seated in the tape cassette 1, maintaining the positional relationship shown in FIG. 9. Mismounting of the ribbon winding spool 21 to the tape cassette 1 is thereby impossible.

As shown in FIG. 9, ribbon winding spool hubs 21A, 21B, one at each end of the ribbon winding spool, are rotatably supported in the supporting hole 5 of the upper case 2 and the supporting hole 5 of the lower case 3, respectively. A plurality of vertically oriented trapezoidal engaging ribs 30 are provided at the center position L (designated by broken line L) of the inner wall of the ribbon winding spool 21. Each engaging rib 30 is vertically symmetrical with respect to the central position L.

When the tape cassette 1 is seated in the cassette mount X of the tape printer P, the ribbon winding shaft 65, arranged in the cassette mount X, is inserted into the ribbon winding spool 21. The winding sprockets 66 formed around the ribbon winding shaft 65 engage the engaging ribs 30. At this time, as each of the engaging ribs 30 is formed to be vertically symmetrical with respect to the central position L, in either case of front loading or bottom loading, the winding sprockets 66 of the ribbon winding shaft 65 are able to properly engage a respective engaging rib 30.

Figure 18:
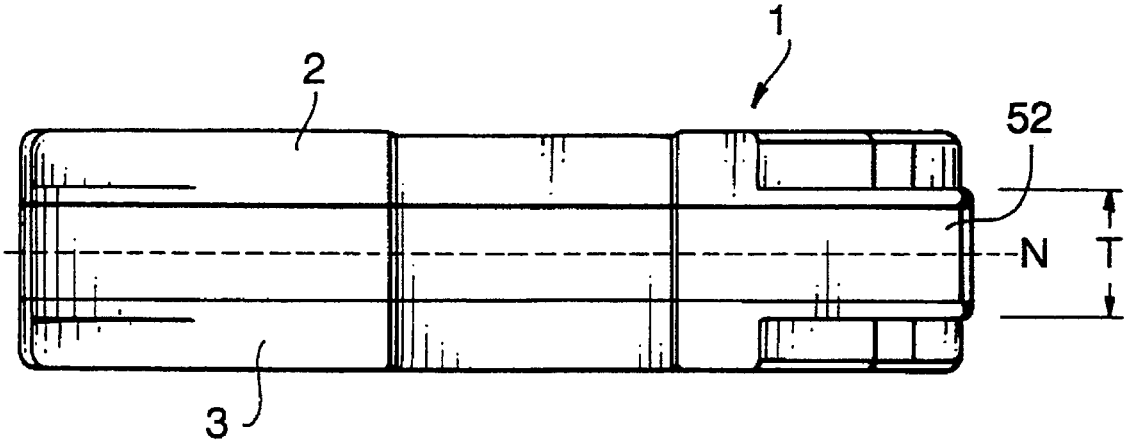
FIG. 18 is a side surface view of the tape cassette.

FIG. 18 is a side view of the tape cassette 1. The tape cassette 1 is constructed such that the lower case 3 is higher than the upper case 2. However, a universal flange 52 (having a height of T), is formed from portions of both of the upper and lower cases 2, 3, to be vertically symmetrical about a center line N in the direction of the height (width) when the tape cassette 1 is assembled.

The height T of the universal flange 52 is set to have the same dimensions regardless of the tape width of the film tape 17 and regardless of the overall width of the cassette 1. For example, a 12 mm thick cassette holding a thin tape has a universal flange 52 the same height T as a 20 mm thick cassette holding a thick tape.

Accordingly, both surfaces of the universal flange 52 are located at the same positions, relative to the central line N, from either of the upper direction and lower directions of the tape cassette 1. Thereby, when the universal flange 52 is used to support the tape cassette 1 within the cassette mount X, it is possible to use the tape cassette 1 in either of a front loading or bottom loading systems. Furthermore, by utilizing the upper and lower surfaces of the universal flange 52, the tape cassette can be positioned correctly in the height direction. If a press member (provided on the lid for opening and closing the cassette mount X of the tape printer P), useful for stabilizing the cassette 1, is designed to press against the universal flange 52, the design of the lid is made easier, both if the lid is arranged on the upper side or on the lower side of the tape printer P.

Figure 19A:
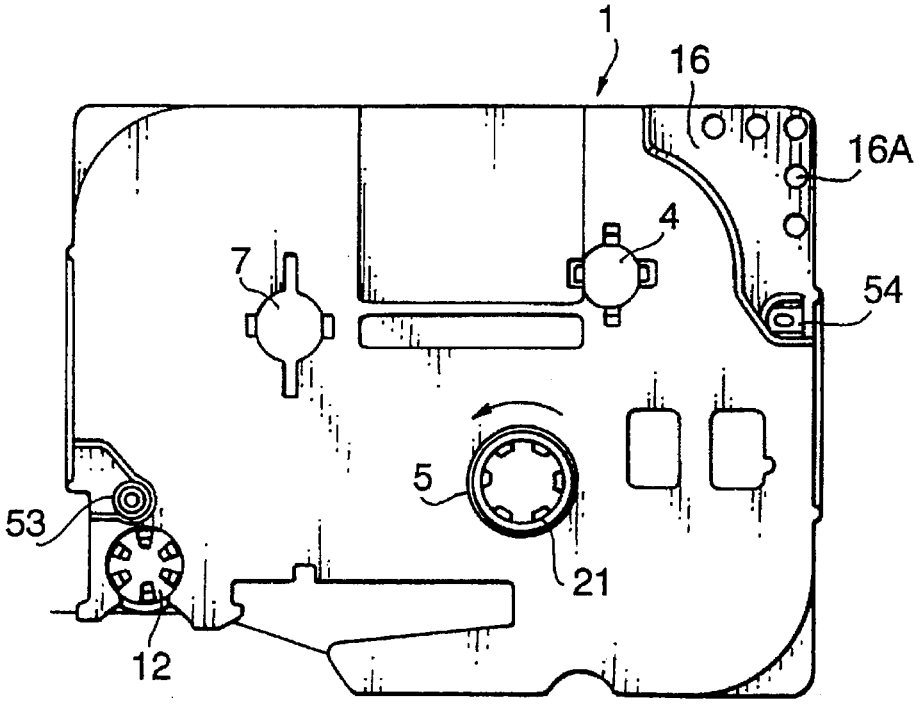
FIG. 19A is a plan view of the tape cassette.
Figure 19B:
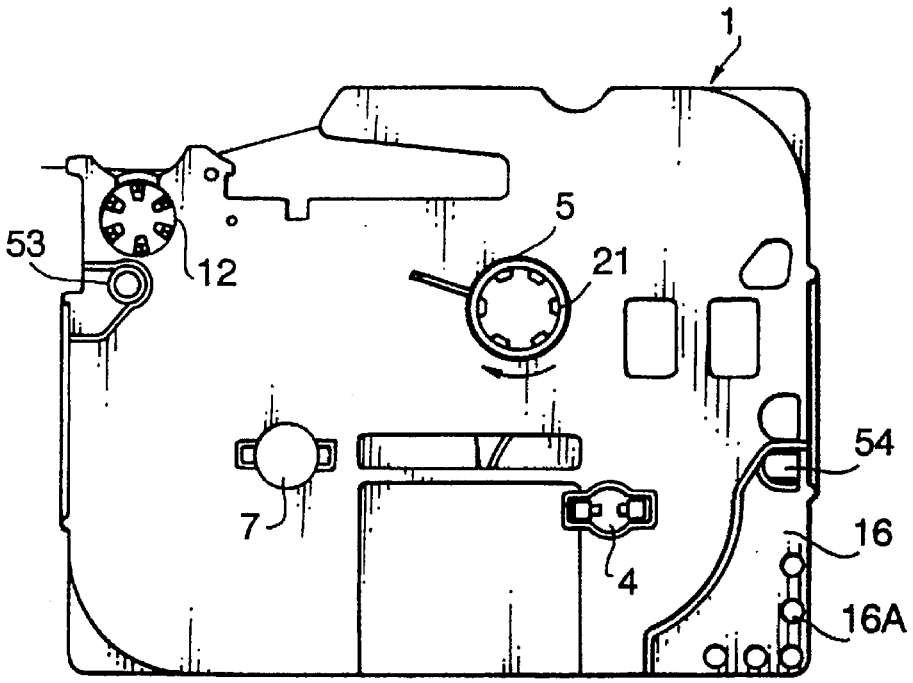
FIG. 19B is a rear surface view of the tape cassette.

As shown in FIGS. 19A, 19B, and 20, the upper and lower cases 2 and 3 are each provided with pin holes 53, 54 which accept the positioning pins 72, 73, respectively, of the cassette mount X. In a further symmetrical feature of the tape cassette 1, the holes are positioned in surfaces symmetrical about the center line N, and equidistant from both surfaces of the tape cassette 1, in the same manner as the universal flange 52. Thus, the tape cassette 1 can be even more precisely positioned within the cassette mount X via the positioning pins 72 and 73 and pin holes 53 and 54, in either case of front loading or bottom loading.

As shown in FIGS. 21 and 23, in a further symmetrical feature of the embodiment, a code bank 16 of holes is formed at the right rear position of the tape cassette 1. The code bank 16 is formed from a pattern of holes (also visible in FIGS. 1, 20 and 22) in the universal flange 52. A plurality of switching holes 16*a* of the code bank 16 penetrate the case in a predetermined binary code pattern representative of the type of cassette 1 (for example, type information includes the width of the film tape 17, the colour of the ink coated on the ink ribbon 19, etc.). The pattern is mirrored on top and bottom of the universal flange 52 so that the code pattern can be read by detecting switches 81 in either of front or bottom loading systems. The binary code pattern of the switching holes 16A depends on the type of tape cassette 1, with the open or closed state of a specific hole 16A position corresponding to OFF and On states respectively.

When the tape cassette 1 is seated in the cassette mount X as shown in FIG. 21 (front mounting) and FIG. 23 (bottom mounting), the two outside terminals 81A of the two outside switches 81 in the cassette mount X are depressed, and therefore the switches turned On. Four detecting switches 81 are shown, although the embodiment may have more switches 81. With the four switches shown, the pattern of ON and OFF becomes ON.OFF.OFF.ON, from the left, based upon which the type of the tape cassette 1 can be detected.

Figure 24:
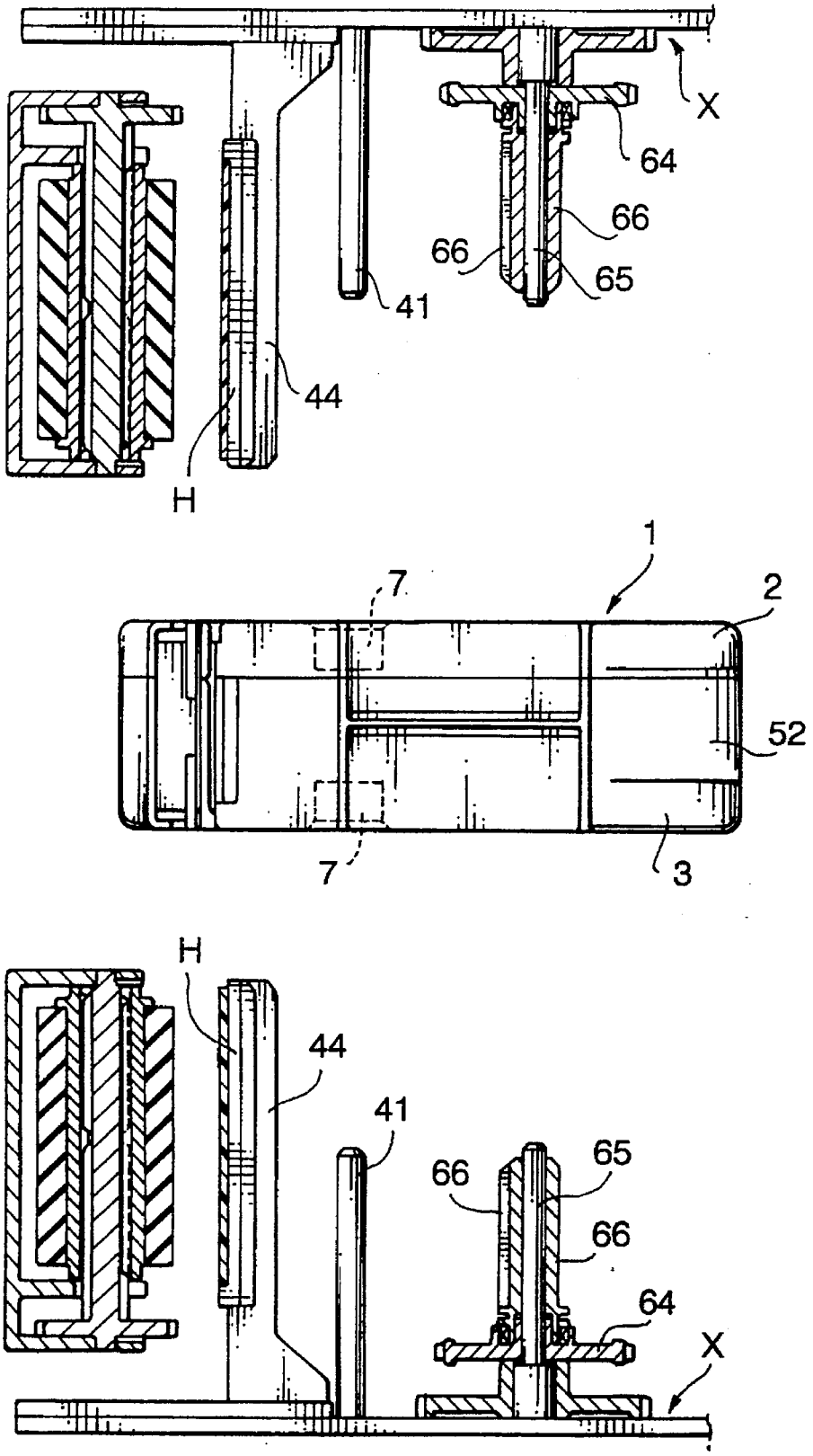
FIG. 24 is an explanatory view schematically showing the tape cassette in both front-loading and bottom-loading situations.

FIGS. 20, 22, and 24 show various states of front and bottom loading. FIG. 20 shows front loading, FIG. 22 shows bottom loading, and FIG. 24 schematically shows a mirrored arrangement of both front and bottom loading.

If the tape cassette 1 is seated in the cassette mount X from the condition illustrated in FIG. 20, if the drive motor 60 is rotated in a counterclockwise direction, then the ribbon winding shaft 65 is rotated in a counterclockwise direction via the gears 61, 62, and 64. As a result, the ribbon winding spool 21 is rotated in the direction of the arrow E, winding up the ink ribbon 19, the engaging ribs 30 driven by the winding sprockets 66 of the ribbon winding shaft 65. Furthermore, the rotation of the gear 64 is transmitted to the tape drive shaft 70 via the gears 67, 68, and 61; the feed capstan 12 is thereby rotated in the clockwise direction, the drive ribs 43 driven by the drive sprockets 69 of the tape drive shaft 70. Then, in cooperation with the press roller 49, the film tape 17 and the adhesive backing 22 are discharged out of the tape cassette 1 through the tape discharge portion 24, adhered to each other.

The same process occurs in the bottom-loading cassette mount X of FIG. 23, with the gears all turning the same direction as described, in order to draw and wind up the ink ribbon 19, to print on the tape 17, and to feed, laminate, and discharge the tape 17 and backing 22.

As shown in FIG. 24 in either case of front or bottom loading, the tape cassette 1 can be seated in the cassette mount X with the upper case 2 facing upward. As described, at least the engaging ribs 30 in the ribbon winding spool 21 (FIG. 9), the driving ribs 43 in the feed capstan 12 (FIG. 14), the universal flange (FIG. 18) 52, and the positioning holes 53, 54 are vertically symmetrical about the centre line N shown in FIG. 18. Accordingly, if the tape cassette 1 is bottom loaded to the cassette mount X facing upward, as illustrated in FIG. 24, the tape cassette 1 is seated in the cassette mount X with the same operating relationship as that of the front loading (the relationship between the respective members of the tape cassette 1 and the tape driving system of the cassette mount X). However, when bottom-loading, the sliding lock piece 40 arranged in the backing spool 23 is moved upwardly via a boss 41 formed on a lid (not shown) that opens and closes the cassette mount X, which is provided on the tape printer P, and thereby the backing spool 23 becomes freely rotatable together with the sliding lock piece 40.

The invention is not limited to the aforementioned embodiments, and can be improved and modified variously within the scope of the invention.

As described herein, according to the invention, in order to isolate the feed paths of the film tape and of the ink ribbon are from each other when the film tape and the ink ribbon are fed within the tape cassette, and the ink ribbon is fed and guided via the guide higher than the outer wall of the lower case. Thus, the influence of the feeding of the ink ribbon on the feeding of the film tape is prevented, and the characters and so on printed on the film tape do not become blurred, nor do the ink ribbon and adhesive become entangled. Furthermore, the molding of the lower case becomes easier, and the wrinkling of the ink ribbon or nipping at the joining surfaces of the upper and lower cases can be prevented. Molding of the lower casing is also easier.

In order to prevent ribbon breakage by retaining an unused portion of the ribbon on either side of the tape when printing, and further to keep the ribbon from tending to follow the film tape towards the feed roller, an ink ribbon having a greater ribbon width than the film tape is utilized, to maintain an unused and unheated ribbon area at all times. Furthermore, regulating members having a spacing therebetween the same as the film tape width, to admit only the film tape past the printing region, are provided in the feeding path downstream of the printing region.

In order to positively align the film tape and adhesive backing, regulating members are provided upstream of a feed capstan, which has a feeding (face) width the same as the width of the film tape, and the regulating members align the film tape to the width of the feed capstan as the aligned backing and tape are fed, laminated, and discharged.

What is claimed is:

1. A tape cassette, comprising:

a cassette casing including an upper case and a lower case, said lower case having an external wall of a predetermined height;

a tape spool, upon which a film tape is wound, said tape spool being rotatably mounted in said casing;

a ribbon spool, upon which an ink ribbon is wound, said ribbon spool being rotatably mounted in said casing;

a feed path, along which said film tape and said ink ribbon are drawn out of said cassette case from the tape spool and ribbon spool, respectively;

a guide portion formed in said lower case and in said feed path, so as to guide said film tape and said ink ribbon, said guide portion being provided with a first wall portion having the same height as that of said external wall;

a second wall portion having a height higher than said first wall portion, and substantially the same as that of said ink ribbon; and a partition wall formed between said first and second wall portions of said guide portion and having a height the same as said second wall portion, wherein said film tape is fed and guided between said first wall portion and said partition wall, and said ink ribbon is fed and guided between said second wall portion and said partition wall.

2. The tape cassette according to claim 1, wherein at least a first pair of regulating members is provided upstream of a printing region of said cassette, said at least a first pair of regulating members regulating the feeding of said film tape to be overlapped with said ink ribbon with a predetermined positional relationship when said film tape and said ink ribbon are in said printing region, downstream along said feed path from said guide portion.

3. The tape cassette according to claim 2, further comprising at least a second pair of regulating members downstream along said feed path from said printing region, and wherein said at least a first pair of regulating members aligns said film tape with said at least a second pair of regulating members.

4. The tape cassette according to claim 3, further comprising:

a guide pin for guiding said film tape to enter said feed path; and a bottom regulating member upstream of said at least a first pair of said regulating members, said bottom regulating member regulating said film tape in the width direction thereof.

5. A tape cassette, comprising:

a film tape wound on a tape spool;

an ink ribbon wound on a ribbon spool, said ink ribbon being wider than said film tape;

a feed capstan, for drawing said film tape from said tape spool;

a ribbon winding spool, for feeding and collecting said ink ribbon;

a feed path, along which said film tape and said ink ribbon proceed, substantially in parallel, from upstream of a printing region of said cassette towards said feed capstans of said cassette, wherein said film tape and said ink ribbon overlap at said printing region along said feed path;

means for regulating, in the width direction, the feeding of said film tape along said feed path, said regulating means regulating the feeding of said film tape such that a portion of a width of said ink ribbon is exposed beyond both edges of said film tape, and said film tape overlaps and covers said remaining center portion of said ink ribbon when said film tape and said ink ribbon are in said printing region, said means for regulating being provided next to said printing region along said feed path.

6. The tape cassette according to claim 5, wherein said means for regulating comprises at least one pair of regulating members having a spacing therebetween the same width as said film tape, and one of said at least one pair of regulating members regulates said film tape on each side of said film tape in said width direction, along said feed path.

7. The tape cassette according to claim 6, further comprising:

a cassette casing having an upper case and a lower case, and wherein one of said at least one pair of regulating members is provided to said upper case, and the remaining of said at least one pair of regulating members is provided to said lower case.

8. The tape according to claim 7, wherein said at least one pair of said regulating members is provided downstream of said printing region.

9. The tape cassette according to claim 7, wherein said at least one pair of said regulating members is provided upstream of said printing region.

10. The tape cassette according to claim 9, wherein a partition wall is provided upstream of said printing region along said feed path to divide said feed path and form a film tape feed path in which only said film tape is fed, and said at least one pair of said regulating members provided upstream of said printing region are disposed in said film tape feed path.

11. The tape cassette according to claim 7, wherein said at least one pair of said regulating members is provided downstream of said printing region, and at least a further pair of said regulating members is provided upstream of said printing region.

12. The tape cassette according to claim 11, wherein said at least one upstream pair of said regulating members aligns said film tape with said at least one downstream pair of said regulating members and said feeding face of said feed capstan.

13. The tape cassette according to claim 9, further comprising;

a guide pin, guiding said film tape to enter said feed path; and a bottom regulating member upstream of said at least one upstream pair of said regulating members, said bottom regulating member regulating said film tape in the width direction thereof.

14. A tape cassette, comprising:

a film tape wound on a tape spool;

an ink ribbon wound on a ribbon spool, said ink ribbon being wider than said film tape;

an adhesive backing tape, wound on a backing spool;

a feed capstan, for drawing said film tape from said tape spool and said adhesive backing from said backing spool, said feed capstan having a feeding face width the same as the width of said film tape;

a ribbon winding spool, for feeding and collecting said ink ribbon;

a feed path, along which said film tape and said ink ribbon proceed, substantially in parallel, from upstream of a printing region of said cassette towards said feed capstan of said cassette, wherein said film tape and said ink ribbon overlap at said printing region along said feed path, and said adhesive backing is overlapped and laminated to said film tape at said feed capstan along said feed path;

means for regulating, in the width direction, the feeding of said film tape along said feed path, said regulating means regulating the feeding of said film tape in said width direction to align said film tape with the feeding face of said feed capstan such that a portion of a width of said ink ribbon is exposed beyond both edges of said film tape, and said film tape overlaps and covers said remaining center portion of said ink ribbon when said film tape and said ink ribbon are in said printing region, and said means for regulating being provided upstream from said feed capstan along said feed path.

15. The tape cassette according to claim 14, wherein said means for regulating comprises at least one pair of regulating members, having a spacing therebetween the same width as said film tape, and said at least one pair of regulating members regulates said film tape on both sides of said film tape in said width direction, along said feed path.

16. The tape cassette according to claim 15, further comprising:

a cassette casing having an upper case and a lower case, and wherein one of said at least one pair of regulating members is provided to said upper case, and the remaining of said at least one pair of regulating members is provided to said lower case.

17. The tape cassette according to claim 16, further comprising:

a guide wall in the vicinity of said at least one pair of regulating members; and a regulating wall provided on the lower case next to said guide wall, a guide channel being formed between said regulating wall and said guide wall, and wherein upstream of said at least one pair of regulating members along said feed path, said ink ribbon is routed away from said feed path and through said guide channel to be collected by said ribbon winding spool.

18. A tape cassette, comprising:

a cassette casing including an upper case and a lower case;

a tape spool, upon which a film tape is wound, said tape spool being rotatably mounted in said casing;

a ribbon spool, upon which an ink ribbon is wound, said ribbon spool being rotatably mounted in said casing;

a head recess formed in said cassette casing, said head recess capable of accommodating a printing head support of a printing device;

a first coupling slot for positively locating said tape cassette in a first lateral direction, said first coupling slot being a vertically extending groove formed in a first wall of said head recess; and a second coupling slot for positively locating said tape cassette in a second lateral direction perpendicular to said first lateral direction, said second coupling slot being a vertically extending groove formed in a second wall of said head recess substantially perpendicular to said first wall of said head recess.

19. A tape cassette mounting system, comprising:

a cassette casing including an upper case and a lower case;

a head recess formed in said cassette casing;

a first coupling slot for positively locating said tape cassette in a first lateral direction, said first coupling slot being a vertically extending groove formed in a first wall of said head recess;

a second coupling slot for positively locating said tape cassette in a second lateral direction perpendicular to said first lateral direction, said second coupling slot being a vertically extending groove formed in a second wall of said head recess substantially perpendicular to said first wall of said head recess;

as printing head support of a printing device, said printing head support bearing a thermal printing head and insertable into said head recess;

a first coupling ridge, said first coupling ridge being a vertically extending ridge formed on a first wall of said head support and slidable into said first coupling slot; and a second coupling ridge, said second coupling ridge being a vertically extending ridge formed on a second wall of said head support substantially perpendicular to said first wall of said head support, and said second coupling ridge being slidable into said second coupling slot.

* * * * *